US007022448B2

(12) United States Patent
Yaguchi et al.

(10) Patent No.: US 7,022,448 B2
(45) Date of Patent: Apr. 4, 2006

(54) ELECTROPHOTOGRAPHIC TONER AND IMAGE-FORMING SYSTEM

(75) Inventors: Shigenori Yaguchi, Ibaraki (JP); Ryuuichi Shimizu, Ibaraki (JP); Junji Kobayashi, Ibaraki (JP); Tadahiro Kaneko, Ibaraki (JP); Nobuyoshi Hoshi, Ibaraki (JP); Tsuneaki Kawanishi, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/652,479

(22) Filed: Sep. 2, 2003

(65) Prior Publication Data

US 2004/0043317 A1 Mar. 4, 2004

(30) Foreign Application Priority Data

Sep. 3, 2002 (JP) ..... P.2002-258195
Oct. 24, 2002 (JP) ..... P.2002-309464

(51) Int. Cl.
*G03G 9/00* (2006.01)

(52) U.S. Cl. ..... 430/108.8; 430/111.4; 430/124; 399/269

(58) Field of Classification Search ..... 430/108.8, 430/106.1, 106.2, 111.4, 124; 399/269
See application file for complete search history.

(56) References Cited

U.S. PATENT DOCUMENTS

| | | | | |
|---|---|---|---|---|
| 5,298,354 | A * | 3/1994 | Matsunaga et al. | 430/99 |
| 5,923,933 | A * | 7/1999 | Anzai et al. | 399/269 |
| 2002/0022189 | A1* | 2/2002 | Kawanishi et al. | 430/108.8 |

FOREIGN PATENT DOCUMENTS

| | | | |
|---|---|---|---|
| JP | 52-3304 | | 1/1977 |
| JP | 52-3305 | | 1/1977 |
| JP | 57-52574 | | 3/1982 |
| JP | 5-313413 | | 11/1993 |
| JP | 6-123994 | | 5/1994 |
| JP | 6-324513 | | 11/1994 |
| JP | 7-36218 | | 2/1995 |
| JP | 7-209909 | | 8/1995 |
| JP | 7-287413 | | 10/1995 |
| JP | 7-287418 | | 10/1995 |
| JP | 8-114942 | | 5/1996 |
| JP | 8-314181 | | 11/1996 |
| JP | 9-179335 | | 7/1997 |
| JP | 9-319139 | | 12/1997 |
| JP | 10-104875 | | 4/1998 |
| JP | 2002-268269 | * | 9/2002 |

OTHER PUBLICATIONS

Japanese Patent Office machine-assisted English-lnaguage translation of JP 2002-268269 (Pub. Sep. 2002).*

* cited by examiner

*Primary Examiner*—Janis L. Dote
(74) *Attorney, Agent, or Firm*—McGinn IP Law Group, PLLC

(57) ABSTRACT

An electrophotographic toner containing: a fixing resin, a colorant, and wax. The wax at least contains hydrocarbon wax having a number-average molecular weight of not higher than 600, and polyethylene wax having a number-average molecular weight of not higher than 600, a melting viscosity of lower than 15 mPa·s at 140° C. and a crystallinity of lower than 95%. A ratio of the hydrocarbon wax to the polyethylene wax is in a range of from 1:10 to 2:1. A maximum of absorption peaks in a heat-up time absorption calorie curve in a DSC curve of the toner measured by a differential scanning calorimeter is at a temperature not higher than 75° C. An onset temperature in absorption of heat is not higher than 65° C.

53 Claims, 1 Drawing Sheet

ELECTROPHOTOGRAPHIC TONER AND IMAGE-FORMING SYSTEM

BACKGROUND OF THE INVENTION

1. Field of the Invention

The present invention relates to an electrophotographic toner used for visualizing an electrostatic charge latent image formed by an electrophotographic method, an electrostatic printing method, an electrostatic recording method, or the like, and an image-forming system and method using the electrophotographic toner.

2. Background Art

For example, in an electrophotographic method, a recording image is formed as follows. A photoconductive light-sensitive material (hereinafter referred to as "photoconductor") is electrostatically charged and exposed to light, so that an electrostatic charge latent image is formed on the photoconductor. Then, the electrostatic charge latent image is developed by a fine particle-like toner containing a colorant, or the like, contained in a resin as a binder. The obtained toner image is transferred onto a sheet of recording paper. Then, the toner image is fixed on the sheet of recording paper to thereby form a recording image. In the process of forming such a recording image, development of the electrostatic charge latent image by the fine particle-like toner and fixation of the toner image on the sheet of recording paper are particularly important steps.

Heretofore, a magnetic-brush developing method using a two-component developing agent made of a toner and a magnetic carrier is used widely as a method of developing an electrostatic charge latent image by a toner. A heat-roller fixing method high in thermal efficiency to make high-speed fixing possible, and a fixing method using a film or the like for improving thermal response characteristic have been put into practical use as a method of fixing the toner on a sheet of recording paper.

In the case of use of such a fixing method, development of a toner capable of being fixed in the condition that the temperature and pressure of the heat roller are reduced to a lower temperature and a lower pressure by reduction in consumed electric power of a fixing heater and a drive motor has been demanded from the following viewpoints of:

(1) shortening the warm-up time unit until fixing can be allowed after the fixing unit starts;

(2) preventing fixing failure due to heat absorption of the sheet of recording paper to thereby make it possible to keep image quality good in continuous paper supply;

(3) preventing the sheet of recording paper from being curled or burned due to overheating; and (4) reducing load applied on the heat roller to thereby simplify the structure of the fixing unit and reduce the size of the fixing unit.

On the other hand, in a recent image-forming system, a laser beam printer using a laser beam for exposing a photoconductive light-sensitive material to light in order to reproduce a recording image by dots on the basis of a modulating signal given by a computer's instruction has been developed with the advance of development of information apparatuses. Particularly, the recent laser beam printer needs to generate an image with higher quality. The size of the laser beam needs to be narrowed and reduced. The dot density needs to be increased in a range of from 600 to 1200 dpi (dots/inch). The particle size of the carrier also needs to be reduced. Therefore, use of a small-particle-size toner having a volume-average particle size of not larger than 10 μm and a small-particle-size carrier having a weight-average particle size of not larger than 100 μm has been advanced.

The cost of such a small-particle-size toner, however, becomes high because the yield in pulverizing and classifying steps is lowered at the time of production of the toner. For this reason, it is generally difficult to put a toner smaller than 4 μm into practical use. Generally, while a fine-particle toner is cut so that the mean particle size of the toner is selected to be in a range of from 4 μm to 10 μm, external additives to be added to the toner are used and the recipe for external additives are improved to improve fluidity of the toner.

On the other hand, with the advance of reduction in particle size of the toner, the particle size of the carrier is reduced to a weight-average particle size of not larger than 100 μm to increase the specific surface area of the carrier to thereby improve characteristic of frictional charge between the carrier and the toner. If the particle size of the carrier is smaller than 30 μm, the magnetic force of the carrier is however reduced so that the toner is easily deposited on the electrostatic charge image holding member because of electrostatic suction force. Therefore, the carrier is classified by particle size to obtain a mean particle size range of from 30 μm to 100 μm and surfaces of the carrier particles are coated with a resin as occasion demands.

With the improvement of the particle size distribution and the improvement of fluidity and charging characteristic, the small-particle-size toner and the developing agent have been put into practical use in an image-forming system such as a copying machine or a printer. A problem peculiar to the small-particle-size toner, however, occurs when printing is actually performed by the system and particularly when printing is repeated by 10 pages or more per minute. Reduction in life of the developing agent due to the carrier spent by the toner and reduction in life of the photoconductor due to the photoconductor filmed with the toner occur easily.

With respect to the fixation of the small-particle-size toner, it is difficult to obtain a good image fixing strength because a great deal of energy is required for obtaining a certain fixing strength compared with the fixation of a large-particle-size toner. Particularly in the fixing step, it is necessary to increase the temperature and pressure of the heat roller. Hence, there is a problem that high reliability and simplification of the fixing unit and reduction in size and cost of the fixing unit can hardly be attained. Accordingly, improvement in fixing characteristic of the toner has been strongly demanded in order to solve this problem.

Addition of wax into the fixing resin to improve the fixing characteristic of the toner has been al ready known. For example, this technique has been disclosed in JP-A-52-3304, JP-A-52-3305, JP-A-57-52574, etc. Such waxes are added for the purpose of preventing the toner from being deposited on the heat roller at a low temperature or at a high temperature, that is, preventing a so-called offset phenomenon.

For example, JP-A-5-313413 has disclosed addition of an ethylene- or propylene-α-olefin copolymer having a viscosity of not higher than 10000 poises at 140° C. into a vinyl-based copolymer having a specific molecular weight distribution in order to improve low-temperature fixing characteristic, anti-offset characteristic and non-agglomeration characteristic of the toner.

For the same purpose, JP-A-7-287413 has disclosed addition of paraffin wax having an absorption calorie peak (melting point) of 75° C. to 85° C. measured by a differential scanning calorimeter (DSC), JP-A-8-314181, JP-A-9-

179335 and JP-A-9-319139 have disclosed addition of natural gas-based Fischer-Tropsch wax having a melting point of 85° C. to 110° C. measured by a DSC, JP-A-6-324513 has disclosed addition of polyethylene wax having a melting point of 85° C. to 110° C. measured by a DSC, JP-A-7-36218 has disclosed addition of polyethylene-based wax prepared by removal of a component having a melting point of not higher than 50° C. by a distillation method or the like so as to have a melting point of 70° C. to 120° C. measured by a DSC, and JP-A-8-114942 has disclosed addition of polyethylene wax having a weight-average molecular weight (Mw) of lower than 1000.

On the other hand, fluidity, heat resistance, durability and storage stability of the toner are lowered when low-melting wax is added to the toner. To improve these characteristics, JP-A-6-123994 has disclosed use of wax having a weight-average molecular weight/number-average molecular weight ratio (Mw/Mn) of not higher than 1.5, JP-A-7-209909 has disclosed use of ethylene-based olefin polymer wax having a melting viscosity of 0.5 mPa·s to 10 mPa·s at 140° C. and a rate of penetration of not higher than 3.0 dmm, JP-A-7-287418 has disclosed use of Fischer-Tropsch wax having an average molecular weight of not lower than 1000, and JP-A-10-104875 has disclosed use of a combination of paraffin wax and Fischer-Tropsch wax exhibiting a predetermined viscosity.

Although the fixing characteristic of the toner can be improved by these related-art techniques, the actual situation is that a toner more improved in low-temperature fixing characteristic has been required from the point of view of increase in speed or reduction in energy of a printer. Moreover, more durability against rubbing than that in the related art has been required in recent years because an image is rubbed due to repeated passage of a sheet of recording paper through the system in double-sided printing, multiplex printing, scale-down edition, or the like. Moreover, an electrophotographic developing agent having higher durability against reduction in running cost, reduction in number of maintenance, etc. has been required.

An object of the invention is to provide an electrophotographic toner satisfying the aforementioned needs.

Specifically, a problem that the invention is to solve is to provide a toner in which energy required for fixing the toner is so low that the temperature and pressure of a heat roller can be reduced when a heat-roller fixing method is used, in which an offset phenomenon hardly occurs, which has both high peeling strength and high rubbing strength at a low temperature and which is good in fluidity, heat resistance, durability and storage stability. More specifically, it is to provide an electrophotographic toner in which reduction in life of a developing agent due to a carrier spent by the toner hardly occurs and in which reduction in life of a photoconductor due to the photoconductor filmed with the toner hardly occurs.

Another object of the invention is to provide a stable image-forming system and method using the electrophotographic toner.

SUMMARY OF THE INVENTION

To achieve the object, the invention provides an electrophotographic toner including: a fixing resin, a colorant, and wax, wherein: the wax at least contains hydrocarbon wax having a number-average molecular weight of not higher than 600, and polyethylene wax having a number-average molecular weight of not higher than 600, a melting viscosity of lower than 15 mPa·s at 140° C. and a crystallinity of lower than 95%; and a ratio of the hydrocarbon wax to the polyethylene wax is in a range of from 1:10 to 2:1.

Further, the invention provides an electrophotographic toner including: a fixing resin, a colorant, and wax, wherein: the wax at least contains alpha olefin having a number-average molecular weight of not higher than 600, and polyethylene wax having a number-average molecular weight of not higher than 600, a melting viscosity of lower than 15 mPa·s at 140° C. and a crystallinity of lower than 95%; and a ratio of the alpha olefin to the polyethylene wax is in a range of from 1:10 to 2:1.

Further, the invention provides an electrophotographic toner, including: a fixing resin, a colorant, and wax, wherein the wax at least contains paraffin wax having a number-average molecular weight of 300 to 600, and polyethylene wax having a number-average molecular weight of not higher than 600, a melting viscosity of lower than 10 mPa·s at 140° C. and a crystallinity of lower than 90%; and a ratio of the paraffin wax to the polyethylene wax is in a range of from 1:10 to 2:1.

Further, the invention provides an image-forming system, including: an electrostatic charge holding member; a developing unit that obtains a recording image by visualizing an electrostatic charge latent image formed on an electrostatic charge holding member with an electrophotographic toner; a transfer unit that transfers a visualized toner image onto a recording medium; and a fixing unit that fixes the toner image transferred onto the recording medium; wherein the electrophotographic toner contains a fixing resin, a colorant, and wax; the wax at least contains hydrocarbon wax having a number-average molecular weight of not higher than 600, and polyethylene wax having a number-average molecular weight of not higher than 600, a melting viscosity of lower than 15 mPa·s at 140° C. and a crystallinity of lower than 95%; and a ratio of the hydrocarbon wax to the polyethylene wax is in a range of from 1:10 to 2:1.

Further the invention provides an image-forming system, including: an electrostatic charge holding member; a developing unit that obtains a recording image by visualizing an electrostatic charge latent image formed on an electrostatic charge holding member with an electrophotographic toner; a transfer unit that transfers a visualized toner image onto a recording medium; and a fixing unit that fixes the toner image transferred onto the recording medium; wherein the electrophotographic toner contains a fixing resin, a colorant, and wax; the wax at least contains alpha olefin having a number-average molecular weight of not higher than 600, and polyethylene wax having a number-average molecular weight of not higher than 600, a melting viscosity of lower than 15 mPa·s at 140° C. and a crystallinity of lower than 95%; and a ratio of the alpha olefin to the polyethylene wax is in a range of from 1:10 to 2:1.

Further the invention provides an image-forming system, including: an electrostatic charge holding member; a developing unit that obtains a recording image by visualizing an electrostatic charge latent image formed on an electrostatic charge holding member with an electrophotographic toner; a transfer unit that transfers a visualized toner image onto a recording medium; and a fixing unit that fixes the toner image transferred onto the recording medium; wherein the electrophotographic toner contains a fixing resin, a colorant, and wax; the wax at least contains paraffin wax having a number-average molecular weight of 300 to 600, and polyethylene wax having a number-average molecular weight of not higher than 600, a melting viscosity of lower than 10 mPa·s at 140° C. and a crystallinity of lower than 90%; and a ratio of the paraffin wax to the polyethylene wax is in a range of from 1:10 to 2:1.

Further, the invention provides an image-forming method, including: obtaining a recording image by visualizing an electrostatic charge latent image formed on an electrostatic charge holding member with an electrophotographic toner; transferring a visualized toner image onto a recording medium; and fixing the toner image transferred onto the recording medium; wherein the electrophotographic toner contains a fixing resin, a colorant, and wax; the wax at least contains hydrocarbon wax having a number-average molecular weight of not higher than 600, and polyethylene wax having a number-average molecular weight of not higher than 600, a melting viscosity of lower than 15 mPa·s at 140° C. and a crystallinity of lower than 95%; and a ratio of the hydrocarbon wax to the polyethylene wax is in a range of from 1:10 to 2:1.

Further, the invention provides an image-forming method, including: obtaining a recording image by visualizing an electrostatic charge latent image formed on an electrostatic charge holding member with an electrophotographic toner; transferring a visualized toner image onto a recording medium; and fixing the toner image transferred onto the recording medium; wherein the electrophotographic toner contains a fixing resin, a colorant, and wax; the wax at least contains alpha olefin having a number-average molecular weight of not higher than 600, and polyethylene wax having a number-average molecular weight of not higher than 600, a melting viscosity of lower than 15 mPa·s at 140° C. and a crystallinity of lower than 95%; and a ratio of the alpha olefin to the polyethylene wax is in a range of from 1:10 to 2:1.

Further, the invention provides an image-forming method, including: obtaining a recording image by visualizing an electrostatic charge latent image formed on an electrostatic charge holding member with an electrophotographic toner; transferring a visualized toner image onto a recording medium; and fixing the toner image transferred onto the recording medium; wherein the electrophotographic toner contains a fixing resin, a colorant, and wax; the wax at least contains paraffin wax having a number-average molecular weight of 300 to 600, and polyethylene wax having a number-average molecular weight of not higher than 600, a melting viscosity of lower than 10 mPa·s at 140° C. and a crystallinity of lower than 90%; and a ratio of the paraffin wax to the polyethylene wax is in a range of from 1:10 to 2:1.

BRIEF DESCRIPTION OF THE DRAWINGS

The present invention may be more readily described with reference to the accompanying drawing.

DETAILED DESCRIPTION OF THE PREFERRED EMBODIMENTS

The First Preferred Embodiment

Figure 1:
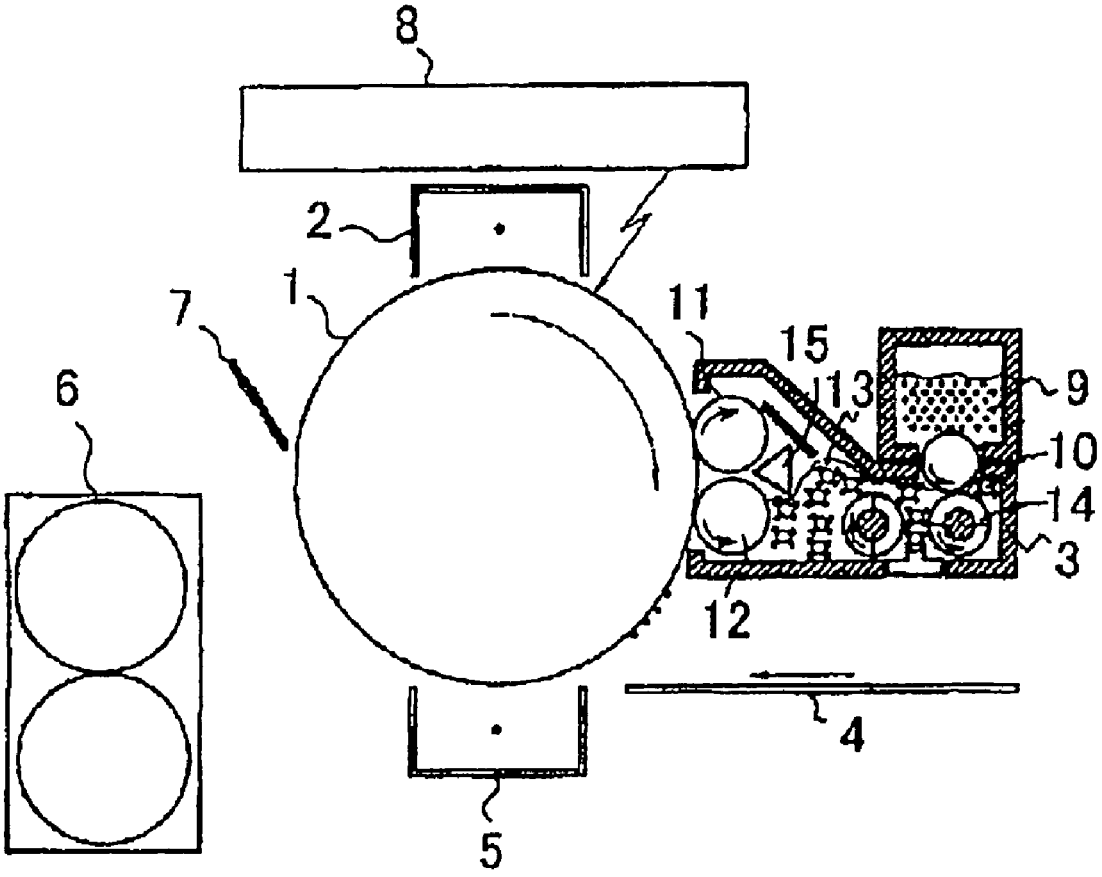
FIG. 1 is a typical view of an image-forming system using an electrophotographic toner according to an embodiment of the invention.

The first preferred embodiment of the invention will be described below in detail.

(Constituent Components of Toner)

An electrophotographic toner according to the first embodiment of the invention contains a fixing resin, a colorant, and wax. The wax contains hydrocarbon wax having a number-average molecular weight of not higher than 600, and polyethylene wax having a number-average molecular weight of not higher than 600, a melting viscosity of lower than 15 mPa·s at 140° C. and a crystallinity of lower than 95%.

When hydrocarbon wax having a number-average molecular weight of not higher than 600 is contained in the toner, the toner can be melted easily by a small amount of heat because the hydrocarbon wax is apt to be melted sharply at a low temperature. As a result, because the toner can be solidified while penetrating into a recording medium such as a sheet of paper in spite of a small amount of heat to thereby exhibit an anchoring effect, a strength against peeling can be obtained easily. It has been also found that the hydrocarbon wax having a number-average molecular weight of not higher than 600 is effective in suppressing reduction in life of the developing agent due to the carrier spent by the toner even in the case where continuous printing is made. In the case where a heat-roller fixing method is used, a high peeling strength can be obtained at a low temperature when the hydrocarbon wax having a number-average molecular weight of not higher than 600 is contained in the toner. If no wax but the hydrocarbon wax having a number-average molecular weight of not higher than 600 is contained in the toner, there is however a high possibility of the offset phenomenon that the toner is deposed on rollers, etc. at the time of fixing and further deposited on the sheet of paper, etc. again.

More durability against rubbing than that in the related art has been required as characteristic of the toner in recent years because an image is rubbed due to repeated passage of a sheet of recording paper through the system in double-sided printing, multiplex printing, scale-down edition, or the like. The wax contained in the toner is effective in improving durability against rubbing. Even in the case where the toner image is rubbed with the sheet of paper, the wax oozes out to the toner surfaces and serves as a lubricant which is effective in restraining the sheet of paper as a part opposite to the toner image from being stained. The effect of durability against rubbing appears remarkably when a great deal of printing matters are printed while piled up, when the toner is used in an image reader having an automatic paper feed mechanism or when a thick sheet of paper such as a name card or a card is printed. A good result of durability against rubbing can be obtained when the printing speed is a range of from a low speed to a high speed. Particularly in a high-speed (40 sheets/min or higher) range, a more remarkable effect can be obtained.

According to examination about various kinds of wax having durability against rubbing, it has found that polyethylene wax having a number-average molecular weight of not higher than 600, a melting viscosity of lower than 15 mPa·s at 140° C. and a crystallinity of lower than 95% is effective in improving durability against rubbing. The polyethylene wax satisfying this characteristic also has a release effect of wax in which the wax can be melted even at a low temperature but a hot offset phenomenon does not occur even at a high temperature.

The toner found according to this examination, that is, the toner using polyethylene wax having a number-average molecular weight of not higher than 600, a melting viscosity of lower than 15 mPa·s at 140° C. and a crystallinity of lower than 95% is more excellent in durability against rubbing than the related-art toner but requirements of energy saving and increase in speed are more stringent. The present inventors have made further examination. As a result, it has been found that the requirements can be satisfied when the hydrocarbon wax having a number-average molecular weight of not higher than 600 and the polyethylene wax having a number-average molecular weight of not higher than 600, a melting viscosity of lower than 15 mPa·s at 140° C. and a crystallinity of lower than 95% are used in combination so that the ratio of the hydrocarbon wax to the polyethylene wax is in a range of from 1:10 to 2:1.

That is, it has been found that when the hydrocarbon wax and the polyethylene wax are used in the aforementioned range, the toner can be solidified while penetrating into the recording medium such as a sheet of paper in spite of a small amount of heat to exhibit an anchoring effect to thereby easily obtain a strength against peeling because the toner can be melted easily by a small amount of heat on the basis of the characteristic of the hydrocarbon wax which is apt to be melted sharply at a low temperature, as well as the toner can obtain excellent durability against rubbing on the basis of characteristic of the polyethylene wax having a number-average molecular weight of not higher than 600, a melting viscosity of lower than 15 mPa·s at 140° C. and a crystallinity of lower than 95%. If the ratio of the hydrocarbon wax to the polyethylene wax is lower than 1:10, strength against peeling becomes insufficient. If the ratio of the hydrocarbon wax to the polyethylene wax is higher than 2:1, durability against rubbing is lowered and a hot offset phenomenon is apt to occur.

On this occasion, the maximum of absorption peaks in a heat-up time absorption calorie curve in a DSC curve of the toner measured by a differential scanning calorimeter needs to be at a temperature not higher than 75° C., and the onset temperature in absorption of heat needs to be not higher than 65° C.

The condition that the maximum of absorption peaks in a heat-up time absorption calorie curve in a DSC curve of the toner is at a temperature not higher than 75° C. and the onset temperature in absorption of heat is not higher than 65° C. is not satisfied though the ratio of the hydrocarbon wax having a number-average molecular weight of not higher than 600 to the polyethylene wax having a number-average molecular weight of not higher than 600, a melting viscosity of lower than 15 mPa·s at 140° C. and a crystallinity of lower than 95% is in a range of from 1:10 to 2:1. The above-mentioned fact means that the hydrocarbon wax and the polyethylene wax are used only in a very small portion so that the effect of improving the fixing characteristic cannot be obtained substantially.

Accordingly, it is preferable that the ratio of the hydrocarbon wax having a number-average molecular weight of not higher than 600 to the polyethylene wax having a number-average molecular weight of not higher than 600, a melting viscosity of lower than 15 mPa·s at 140° C. and a crystallinity of lower than 95% is in a range of from 1:10 to 2:1, and that the condition that the maximum of absorption peaks in a heat-up time absorption calorie curve in a DSC curve of the toner is at a temperature not higher than 75° C. and the onset temperature in absorption of heat is not higher than 65° C., preferably not higher than 55° C. is satisfied. On the other hand, if the onset temperature is not higher than 30° C., the toner is softened under the high-temperature environment at the time of increase in temperature of the developing agent during continuous printing so that agglomeration of the toner is apt to occur because of large lowering of fluidity and large variation in the toner concentration of the developing agent.

The number-average molecular weight of the hydrocarbon wax used in the electrophotographic toner according to the invention is not higher than 600. The hydrocarbon wax can be selected according to required characteristic. Preferably, wax having a molecular weight of 250 to 450 is used as the hydrocarbon wax. For example, paraffin wax or olefin wax can be used as the hydrocarbon wax.

The polyethylene wax used in the invention can be selected according to its function. Preferably, polyethylene wax having a molecular weight of not higher than 600, a melting viscosity of lower than 15 mPa·s (preferably lower than 13 mPa·s, especially preferably lower than 10 mPa·s) at 140° C. and a crystallinity of lower than 95% (preferably not higher than 93%, especially preferably not higher than 90%) in an X-ray diffraction method is used. More preferably, polyethylene wax having a weight-average molecular weight/number-average molecular weight ratio (Mw/Mn) of higher than 1.5 is used. The amount of the wax contained in 100 parts by weight of the fixing resin can be selected to be in a range of from 0.1 parts by weight to 20 parts by weight.

Next, the case where paraffin wax is used as the hydrocarbon wax will be described in detail. When paraffin wax is used, the electrophotographic toner according to the invention at least contains paraffin wax having a number-average molecular weight of 300 to 600, and polyethylene wax having a number-average molecular weight of not higher than 600, a melting viscosity of lower than 10 mPa·s at 140° C. and a crystallinity of lower than 90%.

Because the paraffin wax having a number-average molecular weight of 300 to 600 is apt to be melted sharply at a low temperature, the toner containing the paraffin wax can be melted easily by a small amount of heat. As a result, the toner can be solidified while penetrating into the recording medium such as a sheet of paper in spite of a small amount of heat to exhibit an anchoring effect to thereby easily obtain a strength against peeling. It has been found that when the paraffin wax having a number-average molecular weight of 300 to 600 is used, reduction in life of the developing agent due to the carrier spent by the toner can be restrained even in the case where continuous printing is made.

In the case where a heat-roller fixing method is used, a high peeling strength can be obtained at a low temperature when the paraffin wax having a number-average molecular weight of 300 to 600 is contained in the toner. If no wax but the paraffin wax having a number-average molecular weight of 300 to 600 is contained in the toner, there is however a high possibility of the offset phenomenon that the toner is deposed on rollers, etc. at the time of fixing and further deposited on the sheet of paper, etc. again.

According to the inventors' examination, it has found that polyethylene wax having a number-average molecular weight of not higher than 600, a melting viscosity of lower than 10 mPa·s at 140° C. and a crystallinity of lower than 90% is excellent in durability against rubbing and also has a release effect of wax in which the wax can be melted even at a low temperature but a hot offset phenomenon does not occur even at a high temperature.

The inventors have made further examination. As result, it has been found that when paraffin wax having a number-average molecular weight of 300 to 600 and polyethylene wax having a number-average molecular weight of not higher than 600, a melting viscosity of lower than 10 mPa·s at 140° C. and a crystallinity of lower than 90% are used in combination so that the ratio of the paraffin wax to the polyethylene wax is in a range of from 1:10 to 2:1, the toner can be solidified while penetrating into the recording medium such as a sheet of paper in spite of a small amount of heat to exhibit an anchoring effect to thereby easily obtain a strength against peeling because the toner can be melted easily by a small amount of heat on the basis of the characteristic of the paraffin wax which is apt to be melted sharply at a low temperature, as well as the toner can obtain excellent durability against rubbing on the basis of the characteristic of the polyethylene wax having a number-average molecular weight of not higher than 600, a melting viscosity of lower than 10 mPa·s at 140° C. and a crystallinity of lower than 90%.

If the ratio of the paraffin wax to the polyethylene wax is lower than 1:10, strength against peeling becomes insufficient. If the ratio of the paraffin wax to the polyethylene wax is higher than 2:1, durability against rubbing is lowered and a hot offset phenomenon is apt to occur.

On this occasion, the maximum of absorption peaks in a heat-up time absorption calorie curve in a DSC curve of the toner measured by a differential scanning calorimeter needs to be at a temperature not higher than 75° C., and the onset temperature in absorption of heat needs to be not higher than 55° C.

The condition that the maximum of absorption peaks in a heat-up time absorption calorie curve in a DSC curve of the toner is at a temperature not higher than 75° C. and the onset temperature in absorption of heat is not higher than 55° C. is not satisfied though the ratio of the paraffin wax having a number-average molecular weight of 300 to 600 to the polyethylene wax having a number-average molecular weight of not higher than 600, a melting viscosity of lower than 10 mPa·s at 140° C. and a crystallinity of lower than 90% is in a range of from 1:10 to 2:1. The above-mentioned fact means that the paraffin wax and the polyethylene wax are used only in a very small portion so that the effect of improving the fixing characteristic cannot be obtained substantially. Accordingly, it is necessary that the ratio of the paraffin wax having a number-average molecular weight of 300 to 600 to the polyethylene wax having a number-average molecular weight of not higher than 600, a melting viscosity of lower than 10 mPa·s at 140° C. and a crystallinity of lower than 90% is in a range of from 1:10 to 2:1, and that the condition that the maximum of absorption peaks in a heat-up time absorption calorie curve in a DSC curve of the toner measured by a differential scanning calorimeter is at a temperature not higher than 75° C. and the onset temperature in absorption of heat is not higher than 55° C.

In the electrophotographic toner according to the invention, wax separated and purified from reduced-pressure distilled effluent oil and having a molecular weight of 300 to 600 can be selected as the paraffin wax used according to required characteristic. Preferably, wax having a molecular weight of 400 to 550 is used as the paraffin wax.

The polyethylene wax used in the invention can be selected according to its function. Preferably, polyethylene wax having a molecular weight of not higher than 600, a melting viscosity of lower than 10 mPa·s (preferably lower than 9 mPa·s, especially preferably higher than 8 mPa·s but lower than 9 mPa·s) at 140° C. and a crystallinity of lower than 90% (preferably higher than 75% but lower than 90%, especially preferably not lower than 80% but not higher than 85%) in an X-ray diffraction method is used. More preferably, polyethylene wax having a weight-average molecular weight/number-average molecular weight ratio (Mw/Mn) of higher than 1.5 is used. The amount of the wax contained in 100 parts by weight of the fixing resin can be selected to be in a range of from 0.1 parts by weight to 20 parts by weight.

(Method for Measuring Constituent Components)

(1) Molecular Weight Distribution of Wax

In the invention, the molecular weight distribution of the wax is measured by gel permeation chromatography (GPC) at a high temperature in the following condition.

(Condition for GPC Measurement)

Apparatus: ALC/GPC 150-C (made by Waters Corp.)
Separation Column: GMH-HT 60 cm×1, GMH-HTL 60 cm×1 (made by Tosoh)
Column Temperature: 135° C.
Mobile Phase: o-dicyclobenzene
Detector: differential refractometer
Flow Rate: 1.0 ml/min
Sample Concentration: 0.15 wt %
Injection Amount: 400 μl Measurement is made in the aforementioned condition. The molecular weight of the sample is calculated as follows. A value obtained by using a molecular weight calibration curve prepared on the basis of a monodisperse polystyrene standard sample is expressed in polyethylene on the basis of a conversion equation deduced from a Mark-Houwink-Sakurada equation or a viscosity equation.

(2) DSC of Wax

The DSC measurement of the wax is made as follows. About 5 mg of the toner is weighed and placed on a DSC. While 50 ml/min of nitrogen gas is blown in, the toner is heated from 20° C. to 160° C. at a rate of 10° C./min and then cooled rapidly from 160° C. to 20° C. so that a pre-history is taken. Then, the toner is heated again at a rate of 10° C./min. Peaks of the DSC absorption calorie curve on this occasion are obtained.

(3) Crystallinity of Wax

The crystallinity of the wax is measured by an X-ray diffraction method in the following condition.

X-Ray: Cu-Kα ray (monochromated by a graphite monochromator)
Wavelength λ: 1.5406 Å
Output: 40 kV, 40 mA
Optical System: reflecting method, slit DS, SS=1°, RS=0.3 mm
Measuring Range: 2θ=10° to 35°
Step Interval: 0.02°
Scanning Speed: 2θ/θ continuous scanning 1.00°/min Measurement is made in the condition. The X-ray diffraction profile of the sample is separated into three crystal peaks and amorphous scattering. The crystallinity of the sample is calculated on the basis of areas of the crystal peaks and amorphous scattering by the following equation.

$$\text{Crystallinity (\%)} = Ic/(Ic+Ia)\times 100$$

in which Ic is the sum of the areas of the crystal peaks, and Ia is the sum of the areas of the crystal peaks and the area of the amorphous scattering.

(4) Particle Size of Toner

The particle size of the toner can be measured by various methods. In this invention, a Coulter counter is used. That is, a Coulter counter TA-II Type (made by Coulter Electronics Inc.) with an aperture of 100 μm is used as a measuring device for measuring a number distribution and a volume distribution. On this occasion, a measurement toner is added into an electrolytic solution containing a surface active agent and dispersed for 1 minute by an ultrasonic dispersing device to obtain a measurement sample. 50000 particles of the sample are measured. The mean particle size of the toner is preferably selected to be in a range of from 4 μm to 10 μm. It is further preferable that the percentage of particles contained in the toner and not larger than 4 μm is suppressed to be not higher than 25%. When the particles not larger than 4 μm are suppressed to be not higher than 15% by number, durability is also improved. In a two-component developing agent, the carrier is mixed with several % of the toner so that the toner is charged by friction between the toner and the carrier. The toner not larger than 4 μm is however hardly separated from the carrier, so that the toner touches the carrier for a long time. Accordingly, surfaces of the carrier are apt to become spent. Moreover, the fine particle toner not larger than 4 μm has a disadvantage in low-temperature fixing characteristic because the fine particle toner needs a large amount of thermal energy, compared with a toner large in particle size, when the toner is deposited (fogged) on the non-image portion or fixed. Accordingly, the percentage of particles not larger than 4 μm in all the toner particles is selected to be not higher than 25% by number, preferably not higher than 15% by number, more preferably not higher than 10% by number.

(5) DSC of Toner

The DSC measurement of the toner is made as follows. About 5 mg of the toner is weighed and placed on a DSC. While 50 ml/min of nitrogen gas is blown in, the toner is heated from 20° C. to 200° C. and then cooled from 200° C. to 0° C. at a rate of 10° C./min so that a pre-history is taken. Then, the toner is heated again at a rate of 10° C./min. The maximum absorption peak and the onset temperature are obtained on the basis of the DSC absorption calorie curve on this occasion. When a plurality of absorption peaks are observed, the lowest one of onset temperatures belonging to the absorption peaks is obtained. Incidentally, the onset temperature is defined as the temperature at an intersection point between a base line and a straight line drawn to be tangent to the absorption peak curve from a point at which the differential value of the absorption peak curve is minimized.

(Fixing Resin)

Examples of the fixing resin used in the toner according to the invention include:

homopolymers of styrene and substituted styrene such as polystyrene, poly-p-chlorstyrene, and polyvinyltoluene;

styrene-based copolymers such as styrene-p-chlorstyrene copolymer, styrene-vinyltoluene copolymer, styrene-vinylnaphthalene copolymer, styrene-acrylic ester copolymer, styrene-methacrylic ester copolymer, styrene-methyl α-chlormethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; and polyvinyl chloride, phenol resin, natural modified phenol resin, natural resin-modified maleic resin, acrylic resin, methacrylic resin, polyvinyl acetate, silicone resin, polyester resin, polyurethane resin, polyamide resin, furan resin, epoxy resin, xylene resin, polyvinyl butyral, terpene resin, chroman-indene resin, and petroleum resin.

Preferably, styrene-based copolymer or polyester resin may be used as the fixing resin.

A low hygroscopic resin obtained by graft copolymerization of the polyester resin and styrene or acryl can be also used. Incidentally, the styrene-based polymer or the styrene-based copolymer may be crosslinked or may be a mixture of resins.

In order to perform fixing at a low temperature and prevent high-temperature offset, for example, in the case of styrene to (meth)acrylic resin, the fixing resin may be constituted by a mixture of a high molecular weight polymer and a low molecular weight polymer. The former is effective in securing offset yield strength of the toner. The latter is effective in securing fixing strength of the toner. Composition balance between the two components is important to coexistence of the low-temperature fixing characteristic and the offset yield strength. It is further said that the balance has influence on storage stability.

As the molecular weight distribution of the styrene to (meth)acrylic resin, tetrahydrofuran-soluble components can be measured by gel permeation chromatography (GPC). When the resin is selected to contain a high molecular weight polymer component having a molecular weight higher than 500000 in GPC measurement, and a low molecular weight component having a molecular weight of not higher than 20000 in GPC measurement so that the ratio of the high molecular weight polymer component to the low molecular weight component is in a range of from 20:80 to 60:40, both low-temperature fixing characteristic and anti-offset characteristic can be achieved.

To improve mutual solubility of the fixing resin and the wax, the fixing resin may be synthesized by a copolymerization method in coexistence with the wax in all or part of a synthesis process.

In the method for generating the fixing resin in the presence of the wax by the copolymerization method, the vinyl-based copolymer may contain styrene-based monomer and/or (meth)acrylic ester monomer, and other vinyl-based monomer as constituent units.

When the copolymerization in coexistence with the wax is carried out in all or part of synthesis in the invention, a vinyl-based copolymer containing the wax dispersed uniformly can be at least obtained as a constituent member. Incidentally, the vinyl-based copolymer may be partially crosslinked mainly by a polymerizable monomer having at least two double bonds, e.g., a crosslinker such as divinylbenzene, divinylnaphthalene, ethylene glycol dimethacrylate, 1,3-butanediol dimethacrylate, divinylaniline, divinyl ether, divinylsulfide, or divinylsulfone.

Specific examples of the styrene-based monomer as a constituent unit of the vinyl polymer include styrene, orthomethylstyrene, meta-methylstyrene, alpha-methylstyrene, and 2,4-dimethylstyrene.

Specific examples of the acrylic ester or methacrylic ester-based monomer as a constituent unit of the vinyl polymer include: acrylic or methacrylic alkyl ester such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, and stearyl methacrylate; and 2-chlorethyl acrylate, phenyl acrylate, methyl α-chloracrylate, phenyl methacrylate, dimethylaminoethyl methacrylate, diethylaminoethyl methacrylate, 2-hydroxyethyl methacrylate, glycidyl methacrylate, bisglycidyl methacrylate, polyethylene glycol dimethacrylate, and methacryloxyethyl phosphate. Particularly, ethyl acrylate, propyl acrylate, butyl acrylate, methyl methacrylate, ethyl methacrylate, propyl methacrylate, butyl methacrylate, etc. can be used preferably.

Examples of the other vinyl-based monomer as a constituent unit of the vinyl polymer include: acrylic acid and its α- or β-alkyl derivatives such as acrylic acid, methacrylic acid, α-ethyl acrylate, and crotonic acid; unsaturated dicarboxylic acid and its monoester and diester derivatives such as fumaric acid, maleic acid, citraconic acid, and itaconic acid; and succinic monoacryloyloxyethyl ester, succinic monomethacryloyloxyethyl ester, acrylonitrile, methacrylonitrile, and acrylamide.

(Charge Control Agent)

When a charge control agent is used in the toner according to the invention so that the charge control agent is blended into (internally added to) or mixed with (externally added to) the toner particles, the quantity of charge of the toner can be controlled to a desired value.

Examples of an agent for controlling electrostatic positive charge of the toner include: modified materials due to nigrosine, and aliphatic metal salt; quaternary ammonium salts such as tributylbenzylammonium-1-hydroxy-4-naphthosulfonic acid and tetrabutylammonium tetrafluoroborate, onium salts such as phosphonium salts which are analog to the quaternary ammonium salts, and lake pigments thereof; triphenylmethane dyes and lake pigments thereof; higher fatty acid metal salts; diorganotin oxide such as dibutyltin oxide, dioctyltin oxide, and dicyclohexyltin oxide; and diorganotin borate such as dibutyltin borate, dioctyltin borate, and dicyclohexyltin borate. Any one selected from these examples of the agent may be used singly or two or more kinds selected from these examples of the agent may be used in combination. Particularly, a charge control agent such as a nigrosine-based compound, quaternary ammonium salt or triphenylmethane dye can be used preferably.

An organometallic complex or a chelate compound is effectively used as an agent for controlling electrostatic negative charge of the toner. For example, a monoazo metallic complex, an acetylacetone metallic complex, an aromatic hydroxycarboxylic metallic complex or an aromatic dicarboxylic metallic complex may be used. Other examples include: aromatic hydroxycarboxylic acid, aromatic mono- and poly-carboxylic acid and metal salts, anhydrides and esters thereof; and phenol derivatives such as bisphenol.

When these charge control agents are to be internally added to the toner, it is preferable that 0.1% by weight to 10% by weight of the charge control agents are added to the fixing resin.

(External Additives)

Silica fine powder or the like may be preferably externally added to the toner according to the invention in order to improve developing characteristic, fluidity, charge stability and durability.

Preferably, the silica fine powder or the like used in the invention has a specific surface area of not smaller than 30 $m^2/g$ in terms of nitrogen adsorption measured by a BET method. The amount of the silica fine powder or the like externally added to the toner is in a range of from 0.01% by weight to 5% by weight. As occasion demands, the silica fine powder may be used after treated with a treating agent such as an organic silicon compound or various treating agents such as various organic silicon compounds so that hydrophobic characteristic or charge characteristic can be controlled. The silica fine powder and the treating agents can be selected in accordance with the purpose because fluidity, durability, storage stability, etc. vary according to the kind of the treating agent and the particle size of the fine powder.

Lubricant powder such as TEFLON (trademark registered) resin powder, zinc stearate powder or polyvinylidene fluoride powder may be further used. Especially, polyvinylidene fluoride is preferable. An abrasive such as cerium oxide powder, silicon carbide powder or strontium titanate powder may be further used. Especially, strontium titanate is preferable. A fluidizing agent such as titanium oxide powder or aluminum oxide powder may be further used. Especially, a hydrophobic fluidizing agent is preferable. An anticoagulant, an electrical conduction-donating agent such as carbon black powder, zinc oxide powder, antimony oxide powder or tin oxide powder, or a development enhancing agent such as reversed-polarity white fine particles and black fine particles may be further used by a small amount.

(Magnetic Material)

The toner according to the invention may contain a magnetic material The magnetic material can serve also as a colorant. In the invention, examples of the magnetic material contained in the toner include: iron oxides such as magnetite, hematite and ferrite; metals such as iron, cobalt and nickel; and alloys and mixtures of these metals and metals such as aluminum, cobalt, copper, lead, magnesium, tin, zinc, antimony, calcium, manganese, selenium, titanium, tungsten and vanadium.

Preferably, these magnetic materials have a mean particle size of not larger than 2 μm, preferably in a range of from 0. 1 μm to 0.5 μm. The amount of the magnetic material contained in the toner is preferably selected to be in a range of from 0.1% by weight to 200% by weight with respect to the fixing resin.

(Colorant)

Any suitable pigment or dye may be used as an example of the colorant allowed to be used in the toner according to the invention. Examples of the pigment used as the colorant of the toner include carbon black, aniline black, acetylene black, naphthol yellow, Hansa yellow, rhodamine lake, alizarin lake, ferric oxide red, phthalocyanine blue, and indanthrene blue. These colorants are used by an amount sufficient to keep the optical density of the fixed image. Preferably, 0.2% by weight to 15% by weight of the colorant is added to the resin.

A dye may be further used for the same purpose. Examples of the dye include azo dye, anthraquinone dye, xanthene dye, and methine dye. 0.2% by weight to 15% by weight of these dyes are added to the resin.

(Carrier)

A known material can be used as the carrier in the invention. For example, a resin carrier containing a binder resin, and iron powder, ferrite, magnetite, glass beads and magnetic fine particles dispersed into the binder resin can be used. A coating layer may be provided on each of carrier surfaces. The charge characteristic, electric resistance value, etc. of the carrier can be controlled by the binder resin, the electrostatic chargeable fine particles and the coating layer.

Examples of the binder resin used in the resin carrier include: thermoplastic resins such as a vinyl-based resin, a polyester-based resin, a Nylon-based resin, and a polyolefin-based resin; and thermosetting resins such as a phenol resin.

Examples of fine particles of the magnetic substance may include: magnetite; spinel ferrite such as gamma-iron oxide; spinel ferrite containing at least one kind selected from other metals (Mn, Ni, Zn, Mg, Cu, etc.) than iron; magnetoplumbite type ferrite such as barium ferrite; and iron or alloy particles each having an oxide layer in its surface. The shape of each fine particle of the magnetic substance may be granular, spherical or needle-like. Particularly when high magnetization is required, ferromagnetic fine particles of iron or the like may be preferably used. In consideration of chemical stability, magnetite, spinel ferrite containing gamma-iron oxide or magnetoplumbite type ferrite such as barium ferrite may be preferably used. When the kind and amount of the ferromagnetic fine particles are selected, the resin carrier having desired magnetization can be used. The magnetic characteristic of the carrier on this occasion is preferably selected so that the intensity of magnetization is 30 emu/g to 150 emu/g at 1000 Oe.

The resin carrier can be produced as follows. A melted and kneaded mixture of fine particles of a magnetic substance and an electrically insulating binder resin is sprayed by a spray dryer to thereby produce the resin carrier. Alternatively, a monomer or pre-polymer is subjected to a reaction and hardened in an aqueous solvent in the presence of fine particles of a magnetic substance to thereby produce the resin carrier containing the fine particles of the magnetic substance dispersed into a condensation type binder.

Charge characteristic can be controlled when electrostatically positively or negatively charged fine particles or electrically conductive fine particles are fixed onto surfaces of the magnetic carrier or when surfaces of the magnetic carrier are coated with a resin.

A silicone resin, an acrylic resin, an epoxy resin, a fluororesin, or the like, may be used as the surface coating material. The surface coating material may contain electrostatically positively or negatively charged fine particles or electrically conductive fine particles.

The mixture ratio of the toner to the carrier in the invention is preferably selected so that the toner concentration is 2% by weight to 10% by weight.

(Method for Producing Toner)

The electrophotographic toner according to the invention is produced as follows. First, in the condition that the ratio of hydrocarbon wax having a number-average molecular weight of not higher than 600 to polyethylene wax having a number-average molecular weight of not higher than 600, a melting viscosity of lower than 15 mPa·s at 140° C. and a crystallinity of lower than 95% is selected to be in a range of from 1:10 to 2:1, a fixing resin, a charge control agent, a pigment or dye as a colorant and magnetic powder are used in combination and, as occasion demands, additives are further used in combination with a fixing resin containing the wax dispersed therein uniformly. The mixture is mixed sufficiently by a mixer such as a Henschel mixer or a super mixer.

Alternatively, in the condition that the ratio of paraffin wax having a number-average molecular weight of 300 to 600 to polyethylene wax having a number-average molecular weight of not higher than 600, a melting viscosity of lower than 10 mPa·s at 140° C. and a crystallinity of lower than 90% is selected to be in a range of from 1:10 to 2:1, a fixing resin, a charge control agent, a pigment or dye as a colorant and magnetic powder are used in combination and, as occasion demands, additives are further used in combination with a fixing resin containing the wax dispersed therein uniformly. The mixture is mixed sufficiently by a mixer such as a Henschel mixer or a super mixer.

Then, the mixture is melted and kneaded by a hot-melt kneading device such as a heating roll, a kneader or an extruder so that the raw materials are mixed sufficiently.

Then, the mixture is cooled and solidified. After cooled and solidified, the mixture is pulverized and classified to thereby obtain the toner. As the pulverizing method used on this occasion, a jet mill method, an interparticle collision method, a mechanical pulverizing method, or the like, can be used. In the jet mill method, the toner included in a high-speed air current is made to collide with a collision plate so that the toner is pulverized by energy of the collision. In the interparticle collision method, toner particles are made to collide with one another in an air current. In the mechanical pulverizing method, the toner is supplied into a narrow gap between rotors rotating at a high speed to thereby be pulverized.

The toner particles obtained by the jet mill method or the interparticle collision method are relatively sharp in shape because the toner is pulverized by collision energy. When the mechanical pulverizing method is used, the toner is however pulverized while rubbed in the gap, and the toner surfaces are apt to be spherically shaped by frictional heat generated on this occasion. Particularly in the toner intended to obtain reduction in particle size and low-temperature fixing characteristic, the phenomenon that the toner is melted and deposited on the collision plate at the time of pulverization as pointed out in JP-A-7-287413 can be avoided, and lowering of toner fluidity which is a phenomenon peculiar to the case where wax having a small particle size and a low molecular weight is contained in the toner can be also prevented. Accordingly, the mechanical pulverizing method is preferably used for fine pulverization. As occasion demands, desired additives are deposited on and mixed with the pulverized and classified toner by a mixer such as a Henschel mixer. Thus, the toner containing the additives externally added thereto can be obtained.

The toner can be also obtained by a so-called polymerization method in which polymerization is performed in the presence of a colorant, a charge control agent, wax, etc. when a monomer is polymerized to form a high molecular material. The toner can be further obtained by microencapsulation.

Examples according to the invention will be described below but the invention is not limited thereto.

EXAMPLE 1

Raw materials containing 86% by weight of a styrene-acrylic copolymer resin (trade name: HYMER SB316 made by Sanyo Chemical Industries, Ltd., Mw=238000, Mn=3500), 1% by weight of a chromium-containing metallic dye (trade name: BONTRON S-34 made by Orient Chemical Industries, Ltd.), 8% by weight of carbon black (trade name: MA-100 made by Mitsubishi Chemical Corp.), 1.0% by weight of paraffin wax (trade name: HNP-3 made by Nippon Seiro Co., Ltd., Mn=440 as molecular weight expressed in polyethylene, DSC heat absorption peaks: 53.3° C. and 67.8° C.) and 4% by weight of polyethylene wax (trade name: NEOWAX AL made by Yasuhara Chemical Co., Ltd., Mn=430 as molecular weight expressed in polyethylene, DSC heat absorption peaks: 83.7° C., 98.4° C. and 101.6° C., melting viscosity: 8.5 cp at 140° C., crystallinity: 83%) were preparatorily mixed by a super mixer and kneaded while hot-melted by a biaxial kneader. Then, the mixture was cooled, then pulverized and then classified by a dry air current classifier to thereby obtain particles having a mean particle size of 9 μm. Into the particles, 0.8% by weight of hydrophobic silica (trade name: R972 made by Nippon Aerosil Company) were added and stirred by a HENSCHEL MIXER so that the hydrophobic silica was deposited on surfaces of the particles. Thus, a toner of Example 1 was obtained. Incidentally, the mean particle size of the toner on this occasion was 9.0 μm. The toner contained 8.2% by number of toner particles not larger than 4 μm.

COMPARATIVE EXAMPLE 1

A toner of Comparative Example 1 was obtained in the same manner as in Example 1 except that 5% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) were used as the wax. Incidentally, the mean particle size of the toner on this occasion was 8.8 μm. The toner contained 10.3% by number of toner particles not larger than 4 μm.

EXAMPLE 2

A toner of Example 2 was obtained in the same manner as in Example 1 except that 3% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 2% by weight of polyethylene wax (trade name: NEOWAX AL made by Yasuhara Chemical Co., Ltd., Mn=430 as molecular weight expressed in polyethylene, DSC heat absorption peaks: 83.7° C., 98.4° C. and 101.6° C., melting viscosity: 8.5 cp at 140° C., crystallinity: 83%) were used as the wax. Incidentally, the mean particle size of the toner on this occasion was 8.9 μm. The toner contained 6.7% by number of toner particles not larger than 4 μm.

EXAMPLE 3

A toner of Example 3 was obtained in the same manner as in Example 1 except that 2.5% by weight of paraffin wax (trade name: HNP-3 made by Nippon Seiro Co., Ltd., Mn=440 as molecular weight expressed in polyethylene, DSC heat absorption peaks: 53.3° C. and 67.8° C.) and 2.5% by weight of polyethylene wax (trade name: NEOWAX LS made by Yasuhara Chemical Co., Ltd., Mn=380 as molecular weight expressed in polyethylene, DSC heat absorption peaks: 74.2° C. and 94.3° C., melting viscosity: 8.5 cp at 140° C., crystallinity: 83%) were used as the wax. Incidentally, the mean particle size of the toner on this occasion was 9.2 μm. The toner contained 5.2% by number of toner particles not larger than 4 μm.

EXAMPLE 4

A toner of Example 4 was obtained in the same manner as in Example 1 except that 2% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 3% by weight of polyethylene wax (trade name: PW655N made by Toyo Petrolite Co., Ltd., Mn=530 as molecular weight expressed in polyethylene, DSC heat absorption peaks: 62.2° C. and 92.7° C., melting viscosity: 6 cp at 140° C., crystallinity: 93%) were used as the wax. Incidentally, the mean particle size of the toner on this occasion was 9.0 μm. The toner contained 7.3% by number of toner particles not larger than 4 μm.

EXAMPLE 5

A toner of Example 5 was obtained in the same manner as in Example 1 except that 1.5% by weight of alpha olefin (trade name: VYBAR253 made by Toyo Petrolite Co., Ltd., Mn=310 as molecular weight expressed in polyethylene, DSC heat absorption peaks: 46.4° C. and 63.2° C.) and 3.5% by weight of polyethylene wax (trade name: PW655N made by Toyo Petrolite Co., Ltd., Mn=530 as molecular weight expressed in polyethylene, DSC heat absorption peaks: 62.2° C. and 92.7° C., melting viscosity: 6 cp at 140° C., crystallinity: 93%) were used as the wax. Incidentally, the mean particle size of the toner on this occasion was 8.8 μm. The toner contained 6.2% by number of toner particles not larger than 4 μm.

EXAMPLE 6

A toner of Example 6 was obtained in the same manner as in Example 1 except that 2.5% by weight of paraffin wax (trade name: SP-0145 made by Nippon Seiro Co., Ltd., Mn=290 as molecular weight expressed in polyethylene, DSC heat absorption peaks: 49.0° C. and 63.5° C.) and 2.5% by weight of polyethylene wax (trade name: HIWAX 100P made by Mitsui Chemicals, Inc., Mn=550 as molecular weight expressed in polyethylene, DSC heat absorption peaks: 105.2° C. and 117.7° C., melting viscosity: 12.7 cp at 140° C., crystallinity: 90%) were used as the wax. Incidentally, the mean particle size of the toner on this occasion was 9.2 μm. The toner contained 7.5% by number of toner particles not larger than 4 μm.

COMPARATIVE EXAMPLE 2

A toner of Comparative Example 2 was obtained in the same manner as in Example 1 except that 5% by weight of polypropylene wax (trade name: BISCOL 660P made by Sanyo Chemical Industries, Ltd., Mn=1070 as molecular weight expressed in polyethylene, DSC heat absorption peak: 140.0° C.) were used as the wax. Incidentally, the mean particle size of the toner on this occasion was 9.1 μm. The toner contained 8.6% by number of toner particles not larger than 4 μm.

COMPARATIVE EXAMPLE 3

A toner of Comparative Example 3 was obtained in the same manner as in Example 1 except that 5% by weight of polyethylene wax (trade name: PW1000 made by Toyo Petrolite Co., Ltd., Mn=820 as molecular weight expressed in polyethylene, DSC heat absorption peak: 110.0° C., melting viscosity: 13.7 cp at 140° C., crystallinity: 90%) were used as the wax. Incidentally, the mean particle size of the toner on this occasion was 8.7 μm. The toner contained 9.4% by number of toner particles not larger than 4 μm.

COMPARATIVE EXAMPLE 4

A toner of Comparative Example 4 was obtained in the same manner as in Example 1 except that 3% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 2% by weight of Fischer-Tropsch wax (trade name: SPRAY 30 made by SASOL, Mn=520 as molecular weight expressed in polyethylene, DSC heat absorption peak: 91.9° C., melting viscosity: 6.9 cp at 140° C., crystallinity: 90%) were used as the wax. Incidentally, the mean particle size of the toner on this occasion was 9.0 μm. The toner contained 7.7% by number of toner particles not larger than 4 μm.

Then, fixing characteristic and storage stability of the developing agent obtained in each of Examples and Comparative Examples were evaluated by the following method.

(1) Non-Offset Temperature Range

In an electrophotographic laser beam printer using OPC as a photoconductor, image formation was performed at a printing rate of 60 sheets per minute (i.e., at a printing process speed of 26.7 cm/sec) in the condition of an OPC charged potential of −650 V, a residual potential of −50 V, a developing bias potential of −400 V and a developing portion contrast potential of 350 V. The developing unit used was a center feed type developing unit having developing magnetic rolls rotating in a forward direction and developing magnetic rolls rotating in a backward direction with respect to the direction of movement of the electrostatic charge holding member. The developing gap (the distance between the photoconductor and a developing roll sleeve) was set at 0.8 mm. An image was produced by reversal development. The fixing unit was as follows. An aluminum core covered with a thin tube of a fluororesin (tetrafluoroethylene-perfluoroalkyl vinyl ether copolymer: PFA) (40 μm thick) and provided with a heater lamp in its center portion was used as a heat roll. An aluminum core provided with a silicone rubber layer (7 mm thick) having a rubber hardness of about 30 degrees and covered with a PFA tube as its outermost layer was used as a backup roll. The fixing condition was selected so that the process speed was 26.7 cm/sec, the outer diameter of each of the heat roll and the backup roll was 60 Φmm, the pressing load was 50 kgf and the width of the contact (nip) region between the heat roll and the backup roll was about 7 mm. While the control temperature of the heat roll was changed, offset was evaluated on the basis of stain on a blank portion of the fixed image at each surface temperature of the heat roll. Although the heat roll was originally provided with a cleaner of the type of reeling up a roll of Nomex paper impregnated with silicone oil, the cleaner was removed when offset was evaluated. That is, an image was recorded on a thick sheet of paper (about 200 μm thick) and on a thin sheet of paper (about 100 μm thick) in a state in which silicone oil was absent. Low-temperature offset was evaluated in the former. High-temperature offset was evaluated in the latter.

(2) Fixing Strength

The surface temperature of the heat roll of the fixing unit was set at 175° C. A 1-inch square solid black image recorded on the thick sheet of paper (about 200 μm thick) and a lineal drawing at laser beam intervals of 1 ON-state every 4 OFF-states were subjected to a tape peel test and a rubbing test respectively to thereby evaluate the fixing strength of the image.

The tape peel test was carried out as follows. SCOTCH Mending Tape 810 was stuck onto the solid black image. Image densities before and after peeling of the tape were measured by a reflection densitometer (RD-914 made by Macbeth Co.). The tape peel strength was calculated by the following equation.

Tape Peel Strength (%)=(Reflection Density of Solid Black Image after Peeling of Tape/Reflection Density of Solid Black Image before Peeling of Tape)×100

The rubbing test was carried out as follows. The lineal drawing was rubbed with WHATMAN filter paper 44 under a load of 200 gf. The degree of stain on the filter paper was evaluated by a whiteness meter. The light reflectance of stained filter paper relative to non-stained filter paper was calculated as a Hunter value (%) and used as rubbing strength (%).

(3) Storage Stability

The toner was put in a metallic Schale (petri dish) and left at 50° C. for 24 hours in a desiccator in which the humidity was controlled to 91% RH by a moisture conditioning agent. The degree of agglomeration of the toner was evaluated by eye observation.

Tables 1 and 2 show evaluation results of the toner in the aforementioned items.

TABLE 1

| | Toner | | | | |
|---|---|---|---|---|---|
| | Kind | Amount (wt %) | Molecular weight expressed in polyethylene Mn | Maximum absorption peak (° C.) | Onset temperature |
| Example 1 | Paraffin wax HNP-3 | 1 | 440 | 62.1 | 43.1 |
| | NEOWAX AL | 4 | 430 | | |
| Example 2 | Paraffin wax HNP-11 | 3 | 390 | 68.5 | 45.1 |
| | NEOWAX AL | 2 | 430 | | |
| Example 3 | Paraffin wax HNP-3 | 2.5 | 440 | 62.4 | 43.8 |
| | NEOWAX LS | 2.5 | 380 | | |
| Example 4 | Paraffin wax HNP-11 | 2 | 390 | 66.8 | 45.3 |
| | Polyethylene wax PW655N | 3 | 530 | | |
| Example 5 | Alpha olefin VYBAR253 | 2.5 | 310 | 61.6 | 52.0 |
| | Polyethylene wax PW655N | 3.5 | 530 | | |
| Example 6 | Paraffin wax SP-0145 | 2.5 | 290 | 62.4 | 49.5 |
| | HIWAX 100P | 2.5 | 550 | | |
| Comparative Example 1 | Paraffin wax HNP-11 | 5 | 390 | 67.8 | 45.8 |
| Comparative Example 2 | Polypropylene wax BISCOL 660P | 5 | 1070 | 141.2 | 119.3 |
| Comparative Example 3 | Polyethylene wax PW1000 | 5 | 820 | 109.4 | 98 |
| Comparative Example 4 | Paraffin wax HNP-11 | 3 | 390 | 68.2 | 44.9 |
| | Fischer-Tropach wax SPRAY30 | 2 | 520 | | |

TABLE 2

| | Fixing characteristic and storage stability of toner | | | |
|---|---|---|---|---|
| | Non-offset temperature range (° C.) | Tape peel strength (%) | Rubbing strength (%) | Storage stability |
| Example 1 | 155~>220 | 94 | 91 | No agglomeration |
| Example 2 | 155~>220 | 98 | 84 | No agglomeration |
| Example 3 | 155~>220 | 97 | 87 | No agglomeration |
| Example 4 | 155~>220 | 91 | 85 | No agglomeration |
| Example 5 | 155~>220 | 92 | 83 | No agglomeration |
| Example 6 | 155~>220 | 90 | 82 | No agglomeration |
| Comparative Example 1 | 160~175 | 95 | 63 | No agglomeration |
| Comparative Example 2 | 185~>220 | 52 | 57 | No agglomeration |
| Comparative Example 3 | 175~>220 | 72 | 73 | No agglomeration |
| Comparative Example 4 | 165~>220 | 92 | 75 | No agglomeration |

As was obvious from the evaluation results in Tables 1 and 2, in the developing agent according to the invention, offset hardly occurred in a temperature range of from a low temperature to a high temperature, and the fixed image was hardly stained even in the case where the temperature of the fixing unit varied more or less because the non-offset temperature range was wide. Moreover, a tape peel strength of not lower than 90% and a rubbing strength of not lower than 80% were obtained as the fixing strength at a fixing temperature of 175° C. That is, a very high fixing strength was obtained in terms of both tape peel strength and rubbing strength. On the other hand, in the toner of Comparative Example 1, hot offset occurred at a temperature of not lower than 175° C. In the toner obtained in each of Comparative Examples 2 and 3, a sufficient fixing strength could not be obtained as well as the temperature range free from off set was narrow. In the toner of Comparative Example 4, the tape peel strength could be obtained as characteristic of not lower than 90% but the rubbing strength could not reach 80%. In the condition that the image obtained in each of Examples was used as an original repeatedly by 20 times in a commercially available copying machine having an automatic original feed system, stain on the image was checked but there was no stain on the image. On the other hand, in the image obtained in each of Comparative Examples 1 to 4, the image was stained more or less when copying was repeated by 20 times.

Further, the toner was applied to a laser beam printer (which will be described layer) and continuous printing was performed on each of Examples. Even in the case where 300000 pages' continuous printing was performed, reduction in life of the developing agent due to the carrier spent by the toner and reduction in life of the photoconductor due to the photoconductor filmed with the toner could be avoided. Stable images could be obtained.

(Image-Forming System) Next, an example of the image-forming system using the electrophotographic toner according to the invention will be described with reference to FIG. 1.

The image-forming system is configured as follows. An optical unit 8 forms an electrostatic charge latent image on an electrostatic charge holding member 1 electrostatically charged by a charger 2. The electrostatic charge latent image is visualized by a developing unit 3. The visualized toner image is transferred onto a recording medium 4 such as a sheet of paper. While the toner image remaining on the electrostatic charge holding member 1 is cleaned by a cleaning member 7, the toner image transferred onto the recording medium 4 by a transfer unit 5 is fixed by a fixing unit 6. Thus, a recording image is obtained.

A drum-like photoconductor can be used as an example of the electrostatic charge holding member 1. The image-forming system can exhibit good fixing characteristic particularly at a low temperature. The image-forming system is resistant to rubbing and good in fluidity, heat resistance, durability and storage stability of the toner. Reduction in life of the developing agent due to the carrier spent by the toner and reduction in life of the photoconductor due to the photoconductor filmed with the toner hardly occur. Accordingly, a stable image-forming method can be provided.

The developing unit 3 used in the invention can be selected in accordance with the moving speed of the electrostatic charge holding member. In the case of a high-speed printer in which the moving speed of the electrostatic charge holding member is high, a plurality of developing rolls 11 and 12 may be used so that developing can be performed while he developing region is enlarged and the developing time is elongated because developing cannot be performed sufficiently by one developing roll. When such a plurality of developing rolls are used, a high developing capacity is obtained compared with the system using one developing roll. As a result, measures against large-area image printing and improvement of print quality can be attained. Moreover, the toner content of the developing agent 13 can be reduced. In addition, the rotational speed of each developing roll can be reduced. Accordingly, the carrier can be prevented from being spent by the toner due to scattering of the toner and reduction in load imposed on the developing agent. As a result, the developing agent can be further long-lived. Incidentally, in the developing unit 3 shown in FIG. 1, the toner 9 and the carrier 10 are stirred by a stirring member 14.

In the developing method using the plurality of developing rolls, a high developing capacity is obtained in a one-way development in which the developing rolls rotate in a forward direction with respect to the direction of movement of the electrostatic charge holding member, but drawbacks such as background fog, lack of image edges and brush mark of a magnetic brush are apt to occur.

On the other hand, in a one-way development in which the developing rolls rotate in a backward direction with respect to the direction of movement of the electrostatic charge holding member 1, lack of the image rear edge occurs but both background fog and brush mark of a magnetic brush little occur, so that a stable image can be obtained. In the backward-direction development, the developing capacity may be however low because the effective amount of the toner being in contact with the electrostatic charge holding member is small. On the contrary, in a center feed method having both developing rolls 12 rotating in a forward direction and developing rolls 11 rotating in a backward direction as described above, the drawbacks of the aforementioned two developing methods can be overcome. A system using a plurality of developing rolls 11 and 12 and a regulation member 15 is generally known as the center feed type developing unit.

When the developing method is used in combination with the electrophotographic toner according to the invention, an excellent image can be obtained and energy required for fixing the image is low. Moreover, when a heat-roller fixing method is used, the temperature and pressure of the heat roller can be reduced. Moreover, an offset phenomenon hardly occurs. The toner is excellent in fluidity, heat resistance, durability and storage stability. The carrier can be prevented from being spent by the toner, so that the life of the developing agent can be prevented from being reduced due to the carrier spent. The photoconductor can be prevented from being filmed with the toner, so that the life of the photoconductor can be prevented from being reduced due to the filming of the photoconductor. Accordingly, a stable image can be generated.

As is obvious from the description, the electrophotographic toner according to the invention is low in energy required for fixing the toner. When a heat-roller fixing method is used, both temperature and pressure of the heat roller can be reduced. Moreover, an offset phenomenon hardly occurs. There is an effect that both high peel strength and high rubbing strength can be satisfied at a low temperature.

The toner is excellent in fluidity, heat resistance, durability and storage stability. The toner also fulfills an excellent effect that reduction in life of the developing agent due to the carrier spent by the toner and reduction in life of the photoconductor due to the photoconductor filmed with the toner hardly occur.

Further, there is an effect that a stable image-forming system can be provided when the electrophotographic toner is used.

The Second Preferred Embodiment

The second preferred embodiment of the invention will be described below in detail. A toner according to the second embodiment at least contains, as constitutive components, hydrocarbon wax having a number-average molecular weight of not higher than 600, and polyethylene wax having a number-average molecular weight of not higher than 600, a melting viscosity of lower than 15 mPa·s at 140° C. and a crystallinity of lower than 95%. When hydrocarbon wax having a number-average molecular weight of not higher than 600 is contained in the toner, the toner can be melted easily by a small amount of heat because the hydrocarbon wax is apt to be melted sharply at a low temperature. As a result, because the toner can be solidified while penetrating into a recording medium such as a sheet of paper in spite of a small amount of heat to thereby exhibit an anchoring effect, a strength against peeling can be obtained easily. It has been also found that the hydrocarbon wax having a number-average molecular weight of not higher than 600 is effective in suppressing reduction in life of the developing agent due to the carrier spent by the toner even in the case where continuous printing is made. In the case where a heat-roller fixing method is used, a high peeling strength can be obtained at a low temperature when the hydrocarbon wax having a number-average molecular weight of not higher than 600 is contained in the toner.

If no wax but the hydrocarbon wax having a number-average molecular weight of not higher than 600 is contained in the toner, there is however a high possibility of the offset phenomenon that the toner is deposed on rollers, etc. at the time of fixing and further deposited on the sheet of paper, etc. again. Because this phenomenon occurs remarkably when the temperature of the fixing roller is high, this phenomenon is called "hot offset". On the other hand, polypropylene wax, polyethylene wax, Fischer-Tropsch wax, or the like, has been heretofore widely used as wax effective in preventing the hot offset. The related-art wax has been selected and used mainly for the effect of preventing the hot offset.

With respect to characteristic recently required of the toner, as described in JP-A-10-104875, an image is however rubbed due to repeated passage of a sheet of recording paper through the system in double-sided printing, multiplex printing, scale-down edition, or the like. Therefore, more durability against rubbing than that in the related art has been required of the toner. The wax contained in the toner is effective in improving durability against rubbing. Even in the case where the toner image is rubbed with the sheet of paper, the wax oozes out to the toner surfaces and serves as a lubricant which is effective in restraining the sheet of paper as a part opposite to the toner image from being stained. The effect of durability against rubbing appears remarkably when a great deal of printing matters are printed while piled up, when the toner is used in an image reader, or the like, having an automatic paper feed mechanism or when a thick sheet of paper such as a name card or a card is printed. A good result of durability against rubbing can be obtained when the printing speed is a range of from a low speed to a high speed. Particularly in a high-speed (40 sheets/min or higher) region, a more remarkable effect can be obtained. According to examination about various kinds of wax having durability against rubbing, paraffin wax could not satisfy durability against rubbing and insufficient results could be also obtained in polypropylene wax and Fischer-Tropsch wax.

According to further examination, it has been found that polyethylene wax having a number-average molecular weight of not higher than 600, a melting viscosity of lower than 15 mPa·s at 140° C. and a crystallinity of lower than 95% is most effective in improving durability against rubbing. The polyethylene wax satisfying this characteristic also has a release effect of wax in which the wax can be melted even at a low temperature but the hot offset does not occur even at a high temperature. The toner found according to this examination, that is, the toner using polyethylene wax having a number-average molecular weight of not higher than 600, a melting viscosity of lower than 15 mPa·s at 140° C. and a crystallinity of lower than 95% is more excellent in durability against rubbing than the related-art toner but requirements of energy saving and increase in speed are more stringent. We have made further examination. As a result, it has been found that when hydrocarbon wax having a number-average molecular weight of not higher than 600 and polyethylene wax having a number-average molecular weight of not higher than 600, a melting viscosity of lower than 15 mPa·s at 140° C. and a crystallinity of lower than 95% are used in combination so that the ratio of the hydrocarbon wax to the polyethylene wax is in a range of from 1:10 to 2:1, the toner can be solidified while penetrating into the recording medium such as a sheet of paper in spite of a small amount of heat to exhibit an anchoring effect to thereby easily obtain a strength against peeling because the toner can be melted easily by a small amount of heat on the basis of the characteristic of the hydrocarbon wax which is apt to be melted sharply at a low temperature, as well as the toner can obtain excellent durability against rubbing on the basis of the characteristic of the polyethylene wax having a number-average molecular weight of not higher than 600, a melting viscosity of lower than 15 mPa·s at 140° C. and a crystallinity of lower than 95%.

If the ratio of the hydrocarbon wax to the polyethylene wax is lower than 1:10, strength against peeling becomes insufficient. If the ratio of the hydrocarbon wax to the polyethylene wax is higher than 2:1, durability against rubbing is lowered and the hot offset is apt to occur.

On this occasion, the maximum of absorption peaks in a heat-up time absorption calorie curve in a DSC curve of the toner measured by a differential scanning calorimeter needs to be at a temperature not higher than 75° C., and the softening point (T1/2) provided by a flow tester needs to be in a range of from 120° C. to 127° C. The condition that the maximum of absorption peaks in a heat-up time absorption calorie curve in a DSC curve of the toner is at a temperature not higher than 75° C. and the softening point (T1/2) provided by a flow tester is in a range of from 120° C. to 127° C. is not satisfied though the ratio of the hydrocarbon wax having a number-average molecular weight of not higher than 600 to the polyethylene wax having a number-average molecular weight of not higher than 600, a melting viscosity of lower than 15 mPa·s at 140° C. and a crystallinity of lower than 95% is in a range of from 1:10 to 2:1. The above-mentioned fact means that the hydrocarbon wax and the polyethylene wax are used only in a very small portion so that the effect of improving the fixing characteristic cannot be obtained substantially. Accordingly, it is necessary that the ratio of the hydrocarbon wax having a number-average molecular weight of not higher than 600 to the polyethylene wax having a number-average molecular weight of not higher than 600, a melting viscosity of lower than 15 mPa·s at 140° C. and a crystallinity of lower than 95% is in a range of from 1:10 to 2:1, and that the condition that the maximum of absorption peaks in a heat-up time absorption calorie curve in a DSC curve of the toner is at a temperature not higher than 75° C. and the softening point (T1/2) provided by a flow tester is in a range of from 120° C. to 127° C. is satisfied.

The number-average molecular weight of the hydrocarbon wax used in the electrophotographic toner according to the invention is not higher than 600. The hydrocarbon wax can be selected according to required characteristic. Preferably, wax having a molecular weight of 250 to 450 is used as the hydrocarbon wax. For example, paraffin wax or olefin wax can be used as the hydrocarbon wax.

The polyethylene wax used in the invention can be selected according to its function. Preferably, polyethylene wax having a molecular weight of not higher than 600, a melting viscosity of lower than 15 mPa·s (preferably lower than 13 mPa·s, especially preferably lower than 10 mPa·s) at 140° C. and a crystallinity of lower than 95% (preferably lower than 93%, especially preferably not higher than 90%) in an X-ray diffraction method is used. More preferably, polyethylene wax having a weight-average molecular weight/number-average molecular weight ratio (Mw/Mn) of higher than 1.5 is used.

The amount of the wax contained in 100 parts by weight of the fixing resin can be selected to be in a range of from 0.1 parts by weight to 20 parts by weight.

The molecular weight distribution of the wax in the invention is measured by gel permeation chromatography (GPC) at a high temperature in the following condition.

(GPC Measuring Condition)

Apparatus: ALC/GPC 150-C (made by Waters Corp.)

Separation Column: GMH-HT60 cm×1, GMH-HTL60 cm×1 (made by Tosoh)

Column Temperature: 135° C.

Mobile Phase: o-dichlorobenzene

Detector: differential refractometer

Flow Rate: 1.0 ml/min

Sample Concentration: 0.15% by weight

Injection Quantity: 400 μl

Measurement is made in the condition. The molecular weight of the sample is calculated by using a molecular weight calibration curve generated on the basis of a monodisperse polystyrene standard sample and by using a conversion equation deduced from Mark-Houwink-Sakurada's equation or a viscosity equation for expressing the molecular weight in terms of the molecular weight of polyethylene.

The crystallinity of the wax is measured by an X-ray diffraction method in the following condition.

X-Ray: Cu-Kα ray (monochromated by a graphite monochromator)

Wavelength λ: 1.5406 Å

Output: 40 kV, 40 mA

Optical System: reflecting method, slit DS, SS=1°, RS=0.3 mm

Measuring Range: 2θ=10° to 35°

Step Interval: 0.02°

Scanning Speed: 2θ/θ continuous scanning 1.00°/min

Measurement is made in the condition. The X-ray diffraction profile of the sample is separated into three crystal peaks and amorphous scattering. The crystallinity of the sample is calculated on the basis of areas of the crystal peaks and amorphous scattering by the following equation.

$$\text{Crystallinity } (\%) = Ic/(Ic+Ia)\times 100$$

in which Ic is the sum of the areas of the crystal peaks, and Ia is the sum of the areas of the crystal peaks and the area of the amorphous scattering.

The particle size of the toner can be measured by various methods. In this invention, a COULTER counter is used. That is, a COULTER counter TA-II Type (made by Coulter Electronics Inc.) with an aperture of 100 μm is used as a measuring device for measuring a number distribution and a volume distribution. On this occasion, a measurement toner is added into an electrolytic solution containing a surface active agent and dispersed for 1 minute by an ultrasonic dispersing device to obtain a measurement sample. 50000 particles of the sample are measured. The mean particle size of the toner is preferably selected to be in a range of from 4 μm to 10 μm. It is further preferable that the percentage of particles contained in the toner and not larger than 4 μm is suppressed to be not higher than 25% by number.

When the percentage of the particles not larger than 4 μm is suppressed to be not higher than 15% by number, durability is also improved. In a two-component developing agent, the carrier is mixed with several % of the toner so that the toner is charged by friction between the toner and the carrier. The toner not larger than 4 μm is however hardly separated from the carrier, so that the toner touches the carrier for a long time. Accordingly, surfaces of the carrier are apt to become spent. Moreover, the fine particle toner not larger than 4 μm has a disadvantage in low-temperature fixing characteristic because the fine particle toner needs a large amount of thermal energy, compared with a toner large in particle size, when the toner is deposited (fogged) on the non-image portion or fixed. Accordingly, the percentage of particles not larger than 4 μm in all the toner particles is selected to be not higher than 25% by number, preferably not higher than 15% by number, more preferably not higher than 10% by number.

The DSC measurement of the toner is made as follows. About 5 mg of the toner is weighed and placed on a DSC. While 50 ml/min of nitrogen gas is blown in, the toner is heated from 20° C. to 200° C. and then cooled from 200° C. to 0° C. at a rate of 10° C./min so that a pre-history is taken. Then, the toner is heated again at a rate of 10° C./min. The maximum absorption peak is obtained on the basis of the DSC absorption calorie curve on this occasion.

Measurement of the toner by a flow tester is carried out as follows. After about 1.0 g of the toner is weighed, the toner is press-solidified under pressure of 10 t/cm$^2$ to thereby prepare a sample. After the sample is pre-heated for 5 minutes, measurement is performed in the condition of a start temperature of 50° C., a temperature increase speed of 6.0° C./min, a cylinder load of 20 Kgf·cm$^2$, a cylinder die diameter of 1 mm and a cylinder die length of 10 mm. Then, the value provided by a half temperature method is regarded as the softening point (T1/2)

Examples of the fixing resin used in the toner according to the invention include:

homopolymers of styrene and substituted styrene such as polystyrene, poly-p-chlorstyrene, and polyvinyltoluene;

styrene-based copolymers such as styrene-p-chlorstyrene copolymer, styrene-vinyltoluene copolymer, styrene-vinylnaphthalene copolymer, styrene-acrylic ester copolymer, styrene-methacrylic ester copolymer, styrene-methyl a-chlormethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; and polyvinyl chloride, phenol resin, natural modified phenol resin, natural resin-modified maleic resin, acrylic resin, methacrylic resin, polyvinyl acetate, silicone resin, polyester resin, polyurethane resin, polyamide resin, furan resin, epoxy resin, xylene resin, polyvinyl butyral, terpene resin, chroman-indene resin, and petroleum resin.

Preferably, styrene-based copolymer or polyester resin may be used as the fixing resin.

A low hygroscopic resin obtained by graft copolymerization of the polyester resin and styrene or acryl can be also used. Incidentally, the styrene-based polymer or the styrene-based copolymer may be crosslinked or may be a mixture of resins.

In order to perform fixing at a low temperature and prevent high-temperature offset, for example, in the case of styrene to (meth)acrylic resin, the fixing resin may be constituted by a mixture of a high molecular weight polymer and a low molecular weight polymer. The former is effective in securing offset yield strength of the toner. The latter is effective in securing fixing strength of the toner. Composition balance between the two components is important to coexistence of the low-temperature fixing characteristic and the offset yield strength. It is further said that the balance has influence on storage stability. As the molecular weight distribution of the styrene to (meth) acrylic resin, tetrahydrofuran-soluble components can be measured by gel permeation chromatography (GPC). When the resin is selected to contain a high molecular weight polymer component having a molecular weight higher than 500000 in GPC measurement, and a low molecular weight component having a molecular weight of not higher than 20000 in GPC measurement so that the ratio of the high molecular weight polymer component to the low molecular weight component is in a range of from 20:80 to 60:40, both low-temperature fixing characteristic and anti-offset characteristic can be achieved.

To improve mutual solubility of the fixing resin and the wax, the fixing resin may be synthesized by a copolymerization method in coexistence with the wax in all or part of a synthesis process.

In the method for generating the fixing resin in the presence of the wax by the copolymerization method, the vinyl-based copolymer may contain styrene-based monomer and/or (meth)acrylic ester monomer, and other vinyl-based monomer as constituent units.

When the copolymerization in coexistence with the wax is carried out in all or part of synthesis in the invention, a vinyl-based copolymer containing the wax dispersed uniformly can be at least obtained as a constituent member. Incidentally, the vinyl-based copolymer may be partially crosslinked mainly by a polymerizable monomer having at least two double bonds, e.g., a crosslinker such as divinylbenzene, divinylnaphthalene, ethylene glycol dimethacrylate, 1,3-butanediol dimethacrylate, divinylaniline, divinyl ether, divinylsulfide, or divinylsulfone.

Specific examples of the styrene-based monomer as a constituent unit of the vinyl polymer include styrene, orthomethylstyrene, meta-methylstyrene, alpha-methylstyrene, and 2,4-dimethylstyrene.

Specific examples of the acrylic ester or methacrylic ester-based monomer as a constituent unit of the vinyl polymer include: acrylic or methacrylic alkyl ester such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethyl methacrylate, propyl methacrylate, n-butyl methacrylate, isobutyl methacrylate, n-octyl methacrylate, dodecyl methacrylate, and stearyl methacrylate; and 2-chlorethyl acrylate, phenyl acrylate, methyl α-chloracrylate, phenyl methacrylate, dimethylaminoethyl methacrylate, diethylaminoethyl methacrylate, 2-hydroxyethyl methacrylate, glycidyl methacrylate, bisglycidyl methacrylate, polyethylene glycol dimethacrylate, and methacryloxyethyl phosphate. Particularly, ethyl acrylate, propyl acrylate, butyl acrylate, methyl methacrylate, ethyl methacrylate, propyl methacrylate, butyl methacrylate, etc. can be used preferably.

Examples of the other vinyl-based monomer as a constituent unit of the vinyl polymer include: acrylic acid and its α- or β-alkyl derivatives such as acrylic acid, methacrylic acid, α-ethyl acrylate, and crotonic acid; unsaturated dicarboxylic acid and its monoester and diester derivatives such as fumaric acid, maleic acid, citraconic acid, and itaconic acid; and succinic monoacryloyloxyethyl ester, succinic monomethacryloyloxyethyl ester, acrylonitrile, methacrylonitrile, and acrylamide.

The toner according to the invention may contain a charge control agent blended into (internally added to) or mixed with (externally added to) toner particles so that the quantity of electrostatic charge of the toner can be controlled to a desired value.

Examples of an agent for controlling electrostatic positive charge of the toner include: modified materials due to nigrosine, and aliphatic metal salt; quaternary ammonium salts such as tributylbenzylammonium-1-hydroxy-4-naphthosulfonic acid and tetrabutylammonium tetrafluoroborate, onium salts such as phosphonium salts which are analog to the quaternary ammonium salts, and lake pigments thereof; triphenylmethane dyes and lake pigments thereof; higher fatty acid metal salts; diorganotin oxide such as dibutyltin oxide, dioctyltin oxide, and dicyclohexyltin oxide; and diorganotin borate such as dibutyltin borate, dioctyltin borate, and dicyclohexyltin borate. Any one selected from these examples of the agent may be used singly or two or more kinds selected from these examples of the agent may be used in combination.

Particularly, a charge control agent such as a nigrosine-based compound, quaternary ammonium salt or triphenylmethane dye can be used preferably.

An organometallic complex or a chelate compound is effectively used as an agent for controlling electrostatic negative charge of the toner. For example, a monoazo metallic complex, an acetylacetone metallic complex, an aromatic hydroxycarboxylic metallic complex or an aromatic dicarboxylic metallic complex may be used. Other examples include: aromatic hydroxycarboxylic acid, aromatic mono- and poly-carboxylic acid and metal salts, anhydrides and esters thereof; and phenol derivatives such as bisphenol.

When these charge control agents are to be internally added to the toner, it is preferable that 0.1% by weight to 10% by weight of the charge control agents are added to the fixing resin.

Silica fine powder or the like may be preferably externally added to the toner according to the invention in order to improve developing characteristic, fluidity, charge stability and durability.

Preferably, the silica fine powder or the like used in the invention has a specific surface area of not smaller than 30 $m^2/g$ in terms of nitrogen adsorption measured by a BET method. The amount of the silica fine powder or the like externally added to the toner is in a range of from 0.01% by weight to 5% by weight. As occasion demands, the silica fine powder may be used after treated with a treating agent such as an organic silicon compound or various treating agents such as various organic silicon compounds so that hydrophobic characteristic or charge characteristic can be controlled. The silica fine powder and the treating agents can be selected in accordance with the purpose because fluidity, durability, storage stability, etc. vary according to the kind of the treating agent and the particle size of the fine powder.

Lubricant powder such as TEFLON (trademark registered) resin powder, zinc stearate powder or polyvinylidene fluoride powder may be further used. Especially, polyvinylidene fluoride is preferable. An abrasive such as cerium oxide powder, silicon carbide powder or strontium titanate powder may be further used. Especially, strontium titanate is preferable. A fluidizing agent such as titanium oxide powder or aluminum oxide powder may be further used. Especially, a hydrophobic fluidizing agent is preferable. An anticoagulant, an electrical conduction-donating agent such as carbon black powder, zinc oxide powder, antimony oxide powder or tin oxide powder, or a development enhancing agent such as reversed-polarity white fine particles and black fine particles may be further used by a small amount.

The toner according to the invention may contain a magnetic material. The magnetic material can serve also as a colorant. In the invention, examples of the magnetic material contained in the toner include: iron oxides such as magnetite, hematite and ferrite; metals such as iron, cobalt and nickel; and alloys and mixtures of these metals and metals such as aluminum, cobalt, copper, lead, magnesium, tin, zinc, antimony, calcium, manganese, selenium, titanium, tungsten and vanadium.

Preferably, these magnetic materials have a mean particle size of not larger than 2 μm, preferably in a range of from about 0.1 μm to about 0.5 μm. The amount of the magnetic material contained in the toner is preferably selected to be in a range of from 0.1% by weight to 200% by weight with respect to the fixing resin.

Any suitable pigment or dye may be used as an example of the colorant allowed to be used in the toner according to the invention. Examples of the pigment used as the colorant of the toner include carbon black, aniline black, acetylene black, naphthol yellow, Hansa yellow, rhodamine lake, alizarin lake, ferric oxide red, phthalocyanine blue, and indanthrene blue. These colorants are used by an amount sufficient to keep the optical density of the fixed image. Preferably, 0.2% by weight to 15% by weight of the colorant is added to the resin.

A dye may be further used for the same purpose. Examples of the dye include azo dye, anthraquinone dye, xanthene dye, and methine dye. 0.2% by weight to 15% by weight of these dyes are added to the resin.

The electrophotographic toner according to the invention is produced as follows. In the condition that hydrocarbon wax having a number-average molecular weight of not higher than 600 and polyethylene wax having a number-average molecular weight of not higher than 600, a melting viscosity of lower than 15 mPa·s at 140° C. and a crystallinity of lower than 95% are mixed in a range of from 1:10 to 2:1, a fixing resin, a charge control agent, a pigment or dye as a colorant and magnetic powder are used in combination and, as occasion demands, additives are further used in combination with a fixing resin containing the wax dispersed therein uniformly. The mixture is mixed sufficiently by a mixer such as a Henschel mixer or a super mixer. Then, the mixture is melted and kneaded by a hot-melt kneading device such as a heating roller, a kneader or an extruder so that the raw materials are mixed sufficiently. Then, the mixture is cooled and solidified. Then, the mixture is pulverized and classified to thereby obtain the toner. As the pulverizing method used on this occasion, a jet mill method, an interparticle collision method or a mechanical pulverizing method can be used. In the jet mill method, the toner included in a high-speed air current is made to collide with a collision plate so that the toner is pulverized by energy of the collision. In the interparticle collision method, toner particles are made to collide with one another in an air current. In the mechanical pulverizing method, the toner is supplied into a narrow gap between rotors rotating at a high speed to there by be pulverized. The toner particles obtained by the jet mill method or the interparticle collision method are relatively sharp in shape because the toner is pulverized by collision energy. When the mechanical pulverizing method is used, the toner is however pulverized while rubbed in the gap, and the toner surfaces are apt to be spherically shaped by frictional heat generated on this occasion. Particularly in the toner intended to obtain reduction in particle size and low-temperature fixing characteristic, the phenomenon that the toner is melted and deposited on the collision plate at the time of pulverization as pointed out in JP-A-7-287413 can be avoided, and lowering of toner fluidity which is a phenomenon peculiar to the case where wax having a small particle size and a low molecular weight is contained in the toner can be also prevented. Accordingly, the mechanical pulverizing method is preferably used for fine pulverization. The toner can be also obtained by a so-called polymerization method in which polymerization is performed in the presence of a colorant, a charge control agent, wax, etc. when a monomer is polymerized to form a high molecular material. The toner can be further obtained by microencapsulation. As occasion demands, desired additives may be deposited on and mixed with the prepared toner by a mixer such as a Henschel mixer. Thus, the toner containing the additives externally added thereto can be obtained.

A known material can be used as the carrier in the invention. For example, a resin carrier containing a binder resin, and iron powder, ferrite, magnetite, glass beads and magnetic fine particles dispersed into the binder resin can be used. A coating layer may be provided on each of carrier surfaces. The charge characteristic, electric resistance value, etc. of the carrier can be controlled by the binder resin, the electrostatic chargeable fine particles and the coating layer.

Examples of the binder resin used in the resin carrier include: thermoplastic resins such as a vinyl-based resin, a polyester-based resin, a Nylon-based resin, and a polyolefin-based resin; and thermosetting resins such as a phenol resin.

Examples of the magnetic fine particles may include: magnetite; spinel ferrite such as gamma-iron oxide; spinel ferrite containing at least one kind selected from other metals (Mn, Ni, Zn, Mg, Cu, etc.) than iron; magnetoplumbite type ferrite such as barium ferrite; and iron or alloy particles each having an oxide layer in its surface. The shape of each magnetic fine particle may be granular, spherical or needle-like. Particularly when high magnetization is required, ferromagnetic fine particles of iron or the like may be preferably used. In consideration of chemical stability, magnetite, spinel ferrite containing gamma-iron oxide or magnetoplumbite type ferrite such as barium ferrite may be preferably used. When the kind and amount of the ferromagnetic fine particles are selected, the resin carrier having desired magnetization can be used. The magnetic characteristic of the carrier on this occasion is preferably selected so that the intensity of magnetization is 30 emu/g to 150 emu/g at 1000 Oe.

The resin carrier can be produced as follows. A melted and kneaded mixture of fine particles of a magnetic substance and an electrically insulating binder resin is sprayed by a spray dryer to thereby produce the resin carrier. Alternatively, a monomer or pre-polymer is subjected to a reaction and hardened in an aqueous solvent in the presence of fine particles of a magnetic substance to thereby produce the resin carrier containing the fine particles of the magnetic substance dispersed into a condensation type binder.

Charge characteristic can be controlled when electrostatically positively or negatively charged fine particles or electrically conductive fine particles are fixed onto surfaces of the magnetic carrier or when surfaces of the magnetic carrier are coated with a resin.

A silicone resin, an acrylic resin, an epoxy resin, a fluororesin, or the like, may be used as the surface coating material. The surface coating material may contain electrostatically positively or negatively charged fine particles or electrically conductive fine particles. The mixture ratio of the toner to the carrier in the invention is preferably selected so that the toner concentration is 2% by weight to 10% by weight.

The electrostatic image recording process for obtaining a recording image by using the electrophotographic toner according to the invention is carried out as follows. An electrostatic charge latent image formed on an electrostatic charge holding member is visualized. The visualized toner image is transferred onto a recording medium. While the toner image remaining on the electrostatic charge holding member is cleaned, the toner image transferred onto the recording medium is fixed to thereby obtain a recording image. In the electrostatic image recording process, the toner exhibits good fixing characteristic particularly at a low temperature. The toner is resistant to rubbing and good in fluidity, heat resistance, durability and storage stability. Reduction in life of the developing agent due to the carrier spent by the toner and reduction in life of the photoconductor due to the photoconductor filmed with the toner hardly occur. Accordingly, a stable image-forming method can be provided.

The developing unit used in the invention can be selected in accordance with the moving speed of the electrostatic charge holding member. In the case of a high-speed printer in which the moving speed of the electrostatic charge holding member is high, a plurality of developing magnetic rollers may be preferably used so that developing can be performed while he developing region is enlarged and the developing time is elongated because developing cannot be performed sufficiently by one developing magnetic roller. When such a plurality of developing magnetic rollers are used, a high developing capacity is obtained compared with the system using one developing roller. As a result, measures against large-area image printing and improvement of print quality can be attained. Moreover, the toner content of the developing agent can be reduced. In addition, the rotational speed of each developing roller can be reduced. Accordingly, the carrier can be prevented from being spent by the toner due to scattering of the toner and reduction in load imposed on the developing agent. As a result, the developing agent can be further long-lived.

In the developing method using the plurality of developing rollers, a high developing capacity is obtained in a one-way development in which the developing rollers rotate in a forward direction with respect to the direction of movement of the electrostatic charge holding member, but drawbacks such as background fog, lack of image edges and brush mark of a magnetic brush are apt to occur. On the other hand, in a one-way development in which the developing rollers rotate in a backward direction with respect to the direction of movement of the electrostatic charge holding member, lack of the image rear edge occurs but both background fog and brush mark of a magnetic brush little occur, so that a stable image can be obtained. In the backward-direction development, the developing capacity may be however small because the effective amount of the toner coming into contact with the electrostatic charge holding member is small. On the contrary, in a center feed method having developing rollers rotating in a forward direction and also having developing rollers rotating in a backward direction, the drawbacks of the two developing methods can be avoided. A center feed type developing unit is known, for example, from JP-B-62-45552.

When the developing method is used in combination with the electrophotographic toner according to the invention, an excellent image can be obtained and energy required for fixing the image is low. Moreover, when a heat roller fixing method is used, the temperature and pressure of the heat roller can be reduced. Moreover, an offset phenomenon hardly occurs. The toner is excellent in fluidity, heat resistance, durability and storage stability. The carrier can be prevented from being spent by the toner, so that the life of the developing agent can be prevented from being reduced due to the carrier spent. The photoconductor can be prevented from being filmed with the toner, so that the life of the photoconductor can be prevented from being reduced due to the filming of the photoconductor. Accordingly, a stable image can be produced.

Examples according to the invention will be described below but the invention is not limited thereto.

EXAMPLE 1

Raw materials containing 86% by weight of a styrene-acrylic copolymer resin (trade name: HYMER SB316 made by Sanyo Chemical Industries, Ltd., Mw=238000, Mn=3500), 1% by weight of a chromium-containing metallic dye (trade name: BONTRON S-34 made by Orient Chemical Industries, Ltd.), 8% by weight of carbon black (trade name: MA-100 made by Mitsubishi Chemical Corp.), 1.0% by weight of paraffin wax (trade name: HNP-3 made by Nippon Seiro Co., Ltd., Mn=440 as molecular weight expressed in polyethylene, DSC heat absorption peaks: 53.3° C. and 67.8° C.) and 4% by weight of polyethylene wax (trade name: NEOWAX AL made by Yasuhara Chemical Co., Ltd., Mn=430 as molecular weight expressed in polyethylene, DSC heat absorption peaks: 83.7° C., 98.4° C. and 101.6° C., melting viscosity: 8.5 cp at 140° C., crystallinity: 83%) were preparatorily mixed by a super mixer and kneaded while hot-melted by a biaxial kneader. Then, the mixture was cooled, then pulverized and then classified by a dry air current classifier to thereby obtain particles having a mean particle size of 9 μm. Into the particles, 0.8% by weight of hydrophobic silica (trade name: R972 made by Nippon Aerosil Company) were added and stirred by a HENSCHEL mixer so that the hydrophobic silica was deposited on surfaces of the particles. Thus, a toner of Example 1 was obtained. Incidentally, the mean particle size of the toner on this occasion was 9.0 μm. The toner contained 8.2% by number of toner particles not larger than 4 μm.

COMPARATIVE EXAMPLE 1

A toner of Comparative Example 1 was obtained in the same manner as in Example 1 except that 5% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) were used as the wax. Incidentally, the mean particle size of the toner on this occasion was 8.8 μm. The toner contained 10.3% by number of toner particles not larger than 4 μm.

EXAMPLE 2

A toner of Example 2 was obtained in the same manner as in Example 1 except that 3% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 2% by weight of polyethylene wax (trade name: NEOWAX AL made by Yasuhara Chemical Co., Ltd., Mn=430 as molecular weight expressed in polyethylene, DSC heat absorption peaks: 83.7° C., 98.4° C. and 101.6° C., melting viscosity:. 8.5 cp at 140° C., crystallinity: 83%) were used as the wax. Incidentally, the mean particle size of the toner on this occasion was 8.9 μm. The toner contained 6.7% by number of toner particles not larger than 4 μm.

EXAMPLE 3

A toner of Example 3 was obtained in the same manner as in Example 1 except that 2.5% by weight of paraffin wax (trade name: HNP-3 made by Nippon Seiro Co., Ltd., Mn=440 as molecular weight expressed in polyethylene, DSC heat absorption peaks: 53.3° C. and 67.8° C.) and 2.5% by weight of polyethylene wax (trade name: NEOWAX LS made by Yasuhara Chemical Co., Ltd., Mn=380 as molecular weight expressed in polyethylene, DSC heat absorption peaks: 74.2° C. and 94.3° C., melting viscosity: 8.5 cp at 140° C., crystallinity: 83%) were used as the wax. Incidentally, the mean particle size of the toner on this occasion was 9.2 μm. The toner contained 5.2% by number of toner particles not larger than 4 μm.

EXAMPLE 4

A toner of Example 4 was obtained in the same manner as in Example 1 except that 2% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 3% by weight of polyethylene wax (trade name: PW655N made by Toyo Petrolite Co., Ltd., Mn=530 as molecular weight expressed in polyethylene, DSC heat absorption peaks: 62.2° C. and 92.7° C., melting viscosity: 6 cp at 140° C., crystallinity: 93%) were used as the wax. Incidentally, the mean particle size of the toner on this occasion was 9.0 μm. The toner contained 7.3% by number of toner particles not larger than 4 μm.

EXAMPLE 5

A toner of Example 5 was obtained in the same manner as in Example 1 except that 1.5% by weight of alpha olefin (trade name: VYBAR253 made by Toyo Petrolite Co., Ltd., Mn=310 as molecular weight expressed in polyethylene, DSC heat absorption peaks: 46.4° C. and 63.2° C.) and 3.5% by weight of polyethylene wax (trade name: PW655N made by Toyo Petrolite Co., Ltd., Mn=530 as molecular weight expressed in polyethylene, DSC heat absorption peaks: 62.2° C. and 92.7° C., melting viscosity: 6 cp at 140° C., crystallinity: 93%) were used as the wax. Incidentally, the mean particle size of the toner on this occasion was 8.8 μm. The toner contained 6.2% by number of toner particles not larger than 4 μm.

EXAMPLE 6

A toner of Example 6 was obtained in the same manner as in Example 1 except that 2.5% by weight of paraffin wax (trade name: SP-0145 made by Nippon Seiro Co., Ltd., Mn=290 as molecular weight expressed in polyethylene, DSC heat absorption peaks: 49.0° C. and 63.5° C.) and 2.5% by weight of polyethylene wax (trade name: HIWAX 100P made by Mitsui Chemicals, Inc., Mn=550 as molecular weight expressed in polyethylene, DSC heat absorption peaks: 105.2° C. and 117.7° C., melting viscosity: 12.7 cp at 140° C., crystallinity: 90%) were used as the wax. Incidentally, the mean particle size of the toner on this occasion was 9.2 μm. The toner contained 7.5% by number of toner particles not larger than 4 μm.

COMPARATIVE EXAMPLE 2

A toner of Comparative Example 2 was obtained in the same manner as in Example 1 except that 5% by weight of polypropylene wax (trade name: BISCOL 660P made by Sanyo Chemical Industries, Ltd., Mn=1070 as molecular weight expressed in polyethylene, DSC heat absorption peak: 140.0° C.) were used as the wax. Incidentally, the mean particle size of the toner on this occasion was 9.1 μm. The toner contained 8.6% by number of toner particles not larger than 4 μm.

COMPARATIVE EXAMPLE 3

A toner of Comparative Example 3 was obtained in the same manner as in Example 1 except that 5% by weight of polyethylene wax (trade name: PW1000 made by Toyo Petrolite Co., Ltd., Mn=820 as molecular weight expressed in polyethylene, DSC heat absorption peak: 110.0° C., melting viscosity: 13.7 cp at 140° C., crystallinity: 90%) were used as the wax. Incidentally, the mean particle size of the toner on this occasion was 8.7 μm. The toner contained 9.4% by number of toner particles not larger than 4 μm.

COMPARATIVE EXAMPLE 4

A toner of Comparative Example 4 was obtained in the same manner as in Example 1 except that 3% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 2% by weight of Fischer-Tropsch wax (trade name: SPRAY 30 made by SASOL, Mn=520 as molecular weight expressed in polyethylene, DSC heat absorption peak: 91.9° C., melting viscosity: 6.9 cp at 140° C., crystallinity: 90%) were used as the wax. Incidentally, the mean particle size of the toner on this occasion was 9.0 μm. The toner contained 7.7% by number of toner particles not larger than 4 μm.

Then, fixing characteristic and storage stability of the developing agent obtained in each of Examples and Comparative Examples were evaluated by the following method.

(1) Non-Offset Temperature Range

In an electrophotographic laser beam printer using OPC as a photoconductor, image formation was performed at a printing rate of 70 sheets per minute (i.e., at a printing process speed of 31.4 cm/sec) in the condition of an OPC charged potential of −600 V, a residual potential of −50 V, a developing bias potential of −400 V and a developing portion contrast potential of 350 V. The developing unit used was a center feed type developing unit having developing magnetic rollers rotating in a forward direction and developing magnetic rollers rotating in a backward direction with respect to the direction of movement of the electrostatic charge holding member. The developing gap (the distance between the photoconductor and a developing roller sleeve) was set at 0.8 mm. An image was produced by reversal development.

The fixing unit was as follows. An aluminum core covered with a thin tube of a fluororesin (tetrafluoroethylene-perfluoroalkyl vinyl ether copolymer: PFA) (30 μm thick) and provided with a heater lamp in its center portion was used as a heat roller. An aluminum core provided with a silicone rubber layer (7 mm thick) having a rubber hardness of about 30 degrees and covered with a PFA tube as its outermost layer was used as a backup roller. The fixing condition was selected so that the process speed was 31.4 cm/sec, the outer diameter of each of the heat roller and the backup roller was 60 mm, the pressing load was 60 kgf and the width of the contact (nip) region between the heat roller and the backup roller was about 7 mm. While the control temperature of the heat roller was changed, offset was evaluated on the basis of stain on a blank portion of the fixed image at each surface temperature of the heat roller. Although the heat roller was originally provided with a cleaner of the type of reeling up a roll of Nomex paper impregnated with silicone oil, the cleaner was removed when offset was evaluated. That is, an image was recorded on a thick sheet of paper (about 200 μm thick) and on a thin sheet of paper (about 100 μm thick) in a state in which silicone oil was absent. Low-temperature offset was evaluated in the former. High-temperature offset was evaluated in the latter.

(2) Fixing Strength

The surface temperature of the heat roller of the fixing unit was set at 170° C. A 1-inch square solid black image recorded on the thick sheet of paper (about 200 μm thick) and a lineal drawing at laser beam intervals of 1 ON-state every 4 OFF-states were subjected to a tape peel test and a rubbing test respectively to thereby evaluate the fixing strength of the image.

The tape peel test was carried out as follows. SCOTCH Mending Tape 810 was stuck onto the solid black image. Image densities before and after peeling of the tape were measured by a reflection densitometer (RD-914 made by Macbeth Co.). The tape peel strength was calculated by the following equation.

Tape Peel Strength (%)=(Reflection Density of Solid Black Image after Peeling of Tape/Reflection Density of Solid Black Image before Peeling of Tape)×100

The rubbing test was carried out as follows. The lineal drawing was rubbed with WHATMAN filter paper 44 under a load of 200 gf. The degree of stain on the filter paper was evaluated by a whiteness meter. The light reflectance of stained filter paper relative to non-stained filter paper was calculated as a Hunter value (%) and used as rubbing strength (%).

(3) Storage Stability

The toner was put in a metallic Schale (petri dish) and left at 50° C. for 24 hours in a desiccator in which the humidity was controlled to 91% RH by a moisture conditioning agent. The degree of agglomeration of the toner was evaluated by eye observation.

Tables 3 and 4 show evaluation results of the toner in the items.

TABLE 3

| | Toner | | | | |
|---|---|---|---|---|---|
| | Kind | Amount (wt %) | Molecular weight expressed in polyethylene Mn | Maximum absorption peak (° C.) | Softening point (T1/2) (° C.) |
| Example 1 | Paraffin wax HNP-3 | 1 | 440 | 62.1 | 124.9 |
| | NEOWAX AL | 4 | 430 | | |
| Example 2 | Paraffin wax HNP-11 | 3 | 390 | 68.5 | 120.6 |
| | NEOWPX AL | 2 | 430 | | |
| Example 3 | Paraffin wax HNP-3 | 2.5 | 440 | 62.4 | 123.2 |
| | NEOWAX LS | 2.5 | 380 | | |
| Example 4 | Paraffin wax HNP-11 | 2 | 390 | 66.8 | 126.7 |
| | Polyethylene wax PW655 | 3 | 530 | | |

TABLE 3-continued

| | Toner | | | | |
|---|---|---|---|---|---|
| | Kind | Amount (wt %) | Molecular weight expressed in polyethylene Mn | Maximum absorption peak (° C.) | Softening point (T1/2) (° C.) |
| Example 5 | Alpha olefin VYBAR253 | 1.5 | 310 | 61.6 | 125.8 |
| | Polyethylene wax PW655 | 3.5 | 530 | | |
| Example 6 | Paraffin wax SP-0145 | 2.5 | 290 | 62.4 | 126.5 |
| | HIWAX 100P | 2.5 | 550 | | |
| Comparative Example 1 | Paraffin wax HNP-11 | 5 | 390 | 67.8 | 118.5 |
| Comparative Example 2 | Polypropylene wax BISCOL 660P | 5 | 1070 | 141.2 | 135.7 |
| Comparative Example 3 | Polyethylene wax PW1000 | 5 | 820 | 109.4 | 132 |
| Comparative Example 4 | Paraffin wax HNP-11 | 3 | 390 | 68.2 | 128.1 |
| | Fiacher-Tropsch wax SPRAY30 | 2 | 520 | | |

TABLE 4

| | Fixing characteristic and storage stability of toner | | | |
|---|---|---|---|---|
| | Non-offset temperature range (° C.) | Tape peel strength (%) | Rubbing strength (%) | Storage stability |
| Example 1 | 155~>220 | 94 | 91 | No agglomeration |
| Example 2 | 155~>220 | 98 | 84 | No agglomeration |
| Example 3 | 155~>220 | 97 | 87 | No agglomeration |
| Example 4 | 155~>220 | 91 | 85 | No agglomeration |
| Example 5 | 155~>220 | 92 | 83 | No agglomeration |
| Example 6 | 155~>220 | 90 | 82 | No agglomeration |
| Comparative Example 1 | 155~175 | 95 | 63 | No agglomeration |
| Comparative Example 2 | 185~>220 | 52 | 57 | No agglomeration |
| Comparative Example 3 | 175~>220 | 72 | 73 | No agglomeration |
| Comparative Example 4 | 165~>220 | 90 | 75 | No agglomeration |

As was obvious from the evaluation results in Tables 3 and 4, in the developing agent according to the invention, an offset phenomenon hardly occurred in a temperature range of from a low temperature to a high temperature, and the fixed image was hardly stained even in the case where the temperature of the fixing unit varied more or less because the non-offset temperature range was wide. Moreover, a tape peel strength of not lower than 90% and a rubbing strength of not lower than 80% were obtained as the fixing strength at a fixing temperature of 170° C. That is, a very high fixing strength was obtained in terms of both tape peel strength and rubbing strength. On the other hand, in the toner of Comparative Example 1, hot offset occurred at a temperature of not lower than 175° C.

In the toner obtained in each of Comparative Examples 2 and 3, a sufficient fixing strength could not be obtained as well as the temperature range free from offset was narrow. In the toner of Comparative Example 4, the tape peel strength could be obtained as characteristic of not lower than 90% but the rubbing strength could not reach 80%. In the condition that the image obtained in each of Examples was used as an original repeatedly by 20 times in a commercially available copying machine having an automatic original feed system, stain on the image was checked but there was no stain on the image. On the other hand, as for the image obtained in each of Comparative Examples 1 to 4, the image was stained more or less when copying was repeated by 20 times.

Further, the toner was applied to the laser beam printer and continuous printing was performed on each of Examples. Even in the case where 300000 pages' continuous printing was performed, reduction in life of the developing agent due to the carrier spent by the toner and reduction in life of the photoconductor due to the photoconductor filmed with the toner could be avoided. Stable images could be obtained.

According to the invention, there can be provided an electrographic toner in which energy required for fixing the toner is so low that both temperature and pressure of the heat roller can be reduced when a heat-roller fixing method is used, in which an offset phenomenon hardly occurs, which has both high peel strength and high rubbing strength at a low temperature and which is excellent in fluidity, heat resistance, durability and storage stability so that reduction in life of the developing agent due to the carrier spent by the toner and reduction in life of the photoconductor due to the photoconductor filmed with the toner hardly occur. In addition, a stable image-forming method using the electrographic toner can be provided.

What is claimed is:

1. An electrophotographic toner comprising:

a fixing resin;

a colorant; and a wax, wherein the wax at least comprises:

a hydrocarbon wax having a number-average molecular weight of not higher than 600; and a polyethylene wax having a number-average molecular weight of not higher than 600, a melting viscosity of lower than 15 mPa·s at 140° C. and a crystallinity of lower than 95%, and wherein a ratio of the hydrocarbon wax to the polyethylene wax is in a range of from 1:10 to 2:1.

2. The electrophotographic toner according to claim 1, wherein an amount of the wax contained in 100 parts by weight of the fixing resin is in a range of from 0.1 parts by weight to 20 parts by weight.

3. The electrophotographic toner according to claim 1, wherein the number-average molecular weight of the hydrocarbon wax is in a range of from 250 to 450.

4. The electrophotographic toner according to claim 1, wherein the polyethylene wax has a melting viscosity of lower than 10 mPa·s at 140° C., a crystallinity of not higher than 90% in an X-ray diffraction method, and a weight-average molecular weight/number-average molecular weight ratio (Mw/Mn) of higher than 1.5.

5. The electrophotographic toner according to claim 1, wherein the fixing resin comprises:

a high-molecular weight polymer component higher than 500000; and a low-molecular weight component not higher than 20000 in molecular weight measured by gel permeation chromatography (GPC), and wherein a mixture ratio of the high-molecular weight polymer component to the low-molecular weight component is in a range of from 20:80 to 60:40.

6. The electrophotographic toner according to claim 5, wherein said fixing resin comprises 0.1% by weight to 10% by weight of a charge control agent.

7. The electrophotographic toner according to claim 1, wherein 0.01% by weight to 5% by weight of silica fine powder are externally added to the toner.

8. The electrophotographic toner according to claim 1, wherein the fixing resin comprises 0.1% by weight to 200% by weight of a magnetic material having a mean particle size of not larger than 2 μm.

9. The electrophotographic toner according to claim 1, wherein said fixing resin comprises 0.2% by weight to 15% by weight of a colorant.

10. The electrophotographic toner according to claim 1, wherein a maximum of absorption peaks in a heat-up time absorption calorie curve in a DSC curve of the toner measured by a differential scanning calorimeter is at a temperature not higher than 75° C., and wherein a softening point (T1/2) provided by a flow tester is in a range of from 120° C. to 127° C.

11. The electrophotographic toner according to claim 10, wherein a ratio of a high-molecular weight polymer component higher than 500000 in molecular weight to a low-molecular weight component not higher than 20000 in molecular weight is in a range of from 20:80 to 60:40 when a molecular weight distribution of the toner is measured by gel permeation chromatography (GPC).

12. An electrophotographic toner comprising:

a fixing resin;

a colorant; and a wax, wherein the wax at least comprises:

an alpha olefin having a number-average molecular weight of not higher than 600; and a polyethylene wax having a number-average molecular weight of not higher than 600, a melting viscosity of lower than 15 mPa·s at 140° C. and a crystallinity of lower than 95%, and wherein a ratio of the alpha olefin to the polyethylene wax is in a range of from 1:10 to 2:1.

13. The electrophotographic toner according to claim 12, wherein an amount of the wax contained in 100 parts by weight of the fixing resin is in a range of from 0.1 parts by weight to 20 parts by weight.

14. The electrophotographic toner according to claim 12, wherein the fixing resin comprises:

a high-molecular weight polymer component higher than 500000; and a low-molecular weight component not higher than 20000 in molecular weight measured by gel permeation chromatography (GPC), wherein a mixture ratio of the high-molecular weight polymer component to the low-molecular weight component is in a range of from 20:80 to 60:40.

15. The electrophotographic toner according to claim 14, wherein said fixing resin comprises 0.1% by weight to 10% by weight of a charge control agent.

16. The electrophotographic toner according to claim 12, wherein 0.01% by weight to 5% by weight of silica fine powder are externally added to the toner.

17. The electrophotographic toner according to claim 12, wherein the fixing resin comprises 0.1% by weight to 200% by weight of a magnetic material having a mean particle size of not larger than 2 μm.

18. The electrophotographic toner according to claim 12, wherein said fixing, resin comprises 0.2% by weight to 15% by weight of a colorant.

19. The electrophotographic toner according to claim 12, wherein the crystallinity of the polyethylene wax is lower than 90%, wherein a maximum of absorption peaks in a heat-up time absorption calorie curve in a DSC curve of the toner measured by a differential scanning calorimeter is at a temperature not higher than 75° C., and wherein a softening point (T1/2) provided by a flow tester is in a range of from 120° C. to 127° C.

20. The electrophotographic toner according to claim 19, wherein a ratio of a high-molecular weight polymer component higher than 500000 in molecular weight to a low-molecular weight component not higher than 20000 in molecular weight is in a range of from 20:80 to 60:40 when a molecular weight distribution of the toner is measured by gel permeation chromatography (GPC).

21. An electrophotographic toner, comprising:

a fixing resin;

a colorant; and a wax, wherein the wax at least comprises:

a paraffin wax having a number-average molecular weight of 300 to 600; and a polyethylene wax having a number-average molecular weight of not higher than 600, a melting viscosity of lower than 10 mPa·s at 140° C. and a crystallinity of lower than 90%, and wherein a ratio of the paraffin wax to the polyethylene wax is in a range of from 1:10 to 2:1.

22. The electrophotographic toner according to claim 21, wherein an amount of the wax contained in 100 parts by weight of the fixing resin is in a range of from 0.1 parts by weight to 20 parts by weight.

23. The electrophotographic toner according to claim 21, wherein the fixing resin comprises:

a high-molecular weight polymer component higher than 500000; and a low-molecular weight component not higher than 20000 in molecular weight measured by gel permeation chromatography (GPC), and wherein a mixture ratio of the high-molecular weight polymer component to the low-molecular weight component is in a range of from 20:80 to 60:40.

24. The electrophotographic toner according to claim 23, wherein said fixing resin comprises 0.1% by weight to 10% by weight of a charge control agent.

25. The electrophotographic toner according to claim 21, wherein 0.01% by weight to 5% by weight of silica fine powder are externally added to the toner.

26. The electrophotographic toner according to claim 21, wherein the fixing resin comprises 0.1% by weight to 200% by weight of a magnetic material having a mean particle size of not larger than 2 μm.

27. The electrophotographic toner according to claim 21, wherein said fixing resin comprises 0.2% by weight to 15% by weight of a colorant.

28. The electrophotographic toner according to claim 21, wherein a maximum of absorption peaks in a heat-up time absorption calorie curve in a DSC curve of the toner measured by a differential scanning calorimeter is at a temperature not higher than 75° C., and wherein a softening point (T1/2) provided by a flow tester is in a range of from 120° C. to 127° C.

29. The electrophotographic toner according to claim 28, wherein a ratio of a high-molecular weight polymer component higher than 500000 in molecular weight to a low-molecular weight component not higher than 20000 in molecular weight is in a range of from 20:80 to 60:40 when a molecular weight distribution of the toner is measured by gel permeation chromatography (GPC).

30. An image-forming system, comprising:

an electrostatic charge holding member;

an electrophotographic toner;

a developing unit that obtains a recording image by visualizing an electrostatic charge latent image formed on an electrostatic charge holding member with the electrophotographic toner;

a transfer unit that transfers a visualized toner image onto a recording medium; and a fixing unit that fixes the toner image transferred onto the recording medium;

wherein the electrophotographic toner comprises:

a fixing resin;

a colorant; and a wax, wherein the wax at least comprises:

a hydrocarbon wax having a number-average molecular weight of not higher than 600; and a polyethylene wax having a number-average molecular weight of not higher than 600, a melting viscosity of lower than 15 mPa·s at 140° C. and a crystallinity of lower than 95%, and wherein a ratio of the hydrocarbon wax to the polyethylene wax is in a range of from 1:10 to 2:1.

31. The image-forming system according to claim 30, wherein the developing unit comprises a center feed developing unit using a plurality of developing magnetic rolls including at least one developing magnetic roll rotating in a forward direction and at least one developing magnetic roll rotating in a backward direction with respect to a direction of movement of the electrostatic charge holding member.

32. An image-forming system, comprising:

an electrostatic charge holding member;

an electrophotographic toner;

a developing unit that obtains a recording image by visualizing an electrostatic charge latent image formed on an electrostatic charge holding member with the electrophotographic toner;

a transfer unit that transfers a visualized toner image onto a recording medium; and a fixing unit that fixes the toner image transferred onto the recording medium;

wherein the electrophotographic toner comprises:

a fixing resin;

a colorant; and a wax, wherein the wax at least comprises:

an alpha olefin having a number-average molecular weight of not higher than 600; and a polyethylene wax having a number-average molecular weight of not higher than 600, a melting viscosity of lower than 15 mPa·s at 140° C. and a crystallinity of lower than 95%, and wherein a ratio of the alpha olefin to the polyethylene wax is in a range of from 1:10 to 2:1.

33. The image-fanning system according to claim 32, wherein the developing unit comprises a center feed developing unit using a plurality of developing magnetic rolls including at least one developing magnetic roll rotating in a forward direction and at least one developing magnetic roll rotating in a backward direction with respect to a direction of movement of the electrostatic charge holding member.

34. An image-forming system, comprising:

an electrostatic charge holding member;

an electrophotographic toner;

a developing unit that obtains a recording image by visualizing an electrostatic charge latent image formed on an electrostatic charge holding member with the electrophotographic toner;

a transfer unit that transfers a visualized toner image onto a recording medium; and a fixing unit that fixes the toner image transferred onto the recording medium;

wherein the electrophotographic toner comprises:

a fixing resin;

a colorant; and a wax, wherein the wax at least comprises:

a paraffin wax having a number-average molecular weight of 300 to 600; and a polyethylene wax having a number-average molecular weight of not higher than 600, a melting viscosity of lower than 10 mPa·s at 140° C. and a crystallinity of lower than 90%, and wherein a ratio of the paraffin wax to the polyethylene wax is in a range of from 1:10 to 2:1.

35. The image-forming system according to claim 34, wherein the developing unit comprises a center feed developing unit using a plurality of developing magnetic rolls including at least one developing magnetic roll rotating in a forward direction and at least one developing magnetic roll rotating in a backward direction with respect to a direction of movement of the electrostatic charge holding member.

36. An image-forming method, comprising:

obtaining a recording image by visualizing an electrostatic charge latent image formed on an electrostatic charge holding member with an electrophotographic toner;

transferring a visualized toner image onto a recording medium; and fixing the toner image transferred onto the recording medium;

wherein the electrophotographic toner comprises:

a fixing resin;

a colorant; and a wax, wherein the wax at least comprises:

a hydrocarbon wax having a number-average molecular weight of not higher than 600; and a polyethylene wax having a number-average molecular weight of not higher than 600, a melting viscosity of lower than 15 mPa·s at 140° C. and a crystallinity of lower than 95%, and wherein a ratio of the hydrocarbon wax to the polyethylene wax is in a range of from 1:10 to 2:1.

37. An image-forming method, comprising:

obtaining a recording image by visualizing an electrostatic charge latent image formed on an electrostatic charge holding member with an electrophotographic toner;

transferring a visualized toner image onto a recording medium; and fixing the toner image transferred onto the recording medium;

wherein the electrophotographic toner comprises:

a fixing resin;

a colorant; and a wax, wherein the wax at least comprises:

an alpha olefin having a number-average molecular weight of not higher than 600; and a polyethylene wax having a number-average molecular weight of not higher than 600, a melting viscosity of lower than 15 mPa·s at 140° C. and a crystallinity of lower than 95%, and wherein a ratio of the alpha olefin to the polyethylene wax is in a range of from 1:10 to 2:1.

38. An image-forming method, comprising:

obtaining a recording image by visualizing an electrostatic charge latent image formed on an electrostatic charge holding member with an electrophotographic toner;

transferring a visualized toner image onto a recording medium; and fixing the toner image transferred onto the recording medium;

wherein the electrophotographic toner comprises:

a fixing resin;

a colorant; and a wax, wherein the wax at least comprises:

a paraffin wax having a number-average molecular weight of 300 to 600; and a polyethylene wax having a number-average molecular weight of not higher than 600, a melting viscosity of lower than 10 mPa·s at 140° C. and a crystallinity of lower than 90%, and wherein a ratio of the paraffin wax to the polyethylene wax is in a range of from 1:10 to 2:1.

39. An electrophotographic toner comprising:

a fixing resin;

a colorant; and a wax;

wherein the wax at least comprises;

a hydrocarbon wax having a number-average molecular weight of not higher than 600; and a polyethylene wax having a number-average molecular weight of not higher than 600, a melting viscosity of lower than 15 mPa·s at 140° C. and a crystallinity of lower than 95%, wherein a ratio of the hydrocarbon wax to the polyethylene wax is in a range of from 1:10 to 2:1, wherein a maximum of absorption peaks in a heat-up time absorption calorie carve in a DSC curve of the toner measured by a differential scanning calorimeter is at a temperature not higher than 75° C., and wherein an onset temperature in absorption of heat is not higher than 65° C.

40. The electrophotographic toner according to claim 39, wherein a maximum of absorption peaks in a heat-up time absorption calorie curve in a DSC curve of the toner measured by a differential scanning calorimeter is at a temperature not higher than 75° C., and wherein a softening point (T1/2) provided by a flow tester is in a range of from 120° C. to 127° C.

41. The electrophotographic toner according to claim 40, wherein a ratio of a high molecular weight polymer component higher than 500,000 in molecular weight to a low-molecular weight component not higher than 20,000 in molecular weight is in a range of from 20:80 to 60:40 when a molecular weight distribution of the toner is measured by gel permeation chromatography (GPC).

42. An electrophotographic toner comprising:

a fixing resin;

a colorant; and a wax, wherein the wax at least comprises:

an alpha olefin having a number-average molecular weight of not higher than 600; and a polyethylene wax having a number-average molecular weight of not higher than 600, a melting viscosity of lower than 15 mpa·s at 140° C. and a crystallinity of lower than 95%, wherein a ratio of the alpha olefin to the polyethylene wax is in a range of from 1:10 to 2:1, wherein a maximum of absorption peaks in a beat-up time absorption calorie curve in a DSC curve of the toner measured by a differential scanning calorimeter is at a temperature not higher than 75° C., and wherein an onset temperature in absorption of heat is not higher than 65° C.

43. The electrophotographic toner according to claim 42, wherein the crystallinity of the polyethylene wax is lower than 90%, wherein a maximum of absorption peaks in a heat-up time absorption calorie curve in a DSC curve of the toner measured by a differential scanning calorimeter is at a temperature not higher than 75° C., and wherein a softening point (T1/2) provided by a flow tester is in a range of from 120° C. to 127° C.

44. The electrophotographic toner according to claim 43, wherein a ratio of a high-molecular weight polymer component higher than 500,000 in molecular weight to a low-molecular weight component not higher than 20,000 in molecular weight is in a range of from 20:80 to 60:40 when a molecular weight distribution of the toner is measured by gel permeation chromatography (GPC).

45. An electrophotographic toner, comprising:

a fixing resin;

a colorant; and a wax, wherein the wax at least comprises:

a paraffin wax having a number-average molecular weight of 300 to 600; and a polyethylene wax having a number-average molecular weight of not higher than 600, a melting viscosity of lower than 10 mPa·s at 140° C. and a crystallinity of lower than 90%, wherein a ratio of the paraffin wax to the polyethylene wax is in a range of from 1:10 to 2:1, wherein a maximum of absorption peaks in a heat-up time absorption calorie curve in a DSC curve of the toner measured by a differential scanning calorimeter is at a temperature not higher than 75° C., and wherein an onset temperature in absorption heat is not higher than 55° C.

46. The electrophotographic toner according to claim 45, wherein a maximum of absorption peaks in a heat-up time absorption calorie curve in a DSC curve of the toner measured by a differential scanning calorimeter is at a temperature not higher than 75° C. and wherein a softening point (T1/2) provided by a flow tester is in a range of from 120° C. to 127° C.

47. The electrophotographic toner according to claim 46, wherein a ratio of a high molecular weight polymer component higher than 500,000 in molecular weight to a low-molecular weight component not higher than 20,000 in molecular weight is in a range of from 20:80 to 60:40 when a molecular weight distribution of the toner is measured by gel permeation chromatography (GPC).

48. An image-forming system, comprising:

an electrostatic charge holding member;

an electrophotographic toner;

a developing unit that obtains a recording image by visualizing an electrostatic charge latent image form on an electrostatic charge holding member with the electrophotographic toner;

a transfer unit that transfers a visualized toner image onto a recording medium; and a fixing unit that fixes the toner image transferred onto the recording medium;

wherein the electrophotographic toner comprises:

a fixing resin;

a colorant; and a wax, wherein the wax at least comprises:

a hydrocarbon wax having a number-average molecular weight of not higher than 600, a melting viscosity of lower than 15 mPa·s at 140° C. and a crystallinity of lower than 95%, wherein a ratio of the hydrocarbon wax to the polyethylene wax is in a range of from 1:10 to 2:1, wherein a maximum of absorption peaks in a heat-up time absorption calorie curve in a DSC curve of the toner measured by a differential scanning calorimeter is at a temperature not higher than 75° C., and wherein an onset temperature in absorption of heat is not higher than 65° C.

49. The image-forming system according to claim 48, wherein the developing unit comprises a center feed developing unit using a plurality of developing magnetic rolls including a least one developing magnetic roll rotating in a forward direction and at least one developing magnetic roller rotating in a backward direction with respect to a direction of movement of the electrostatic charge holding member.

50. An image-forming system-comprising:

an electrostatic charge holding member;

an electrophotographic toner;

a developing unit that obtains a recording image by visualizing an electrostatic charge latent image formed on an electrostatic charge latent image formed on an electrostatic charge holding member with the electrophotographic toner;

a transfer unit that transfers a visualized toner image onto a recording medium; and a fixing unit that fixes the toner image transferred onto the recording medium;

wherein the electrophotographic toner comprises:

a fixing resin;

a colorant; and a wax, wherein the wax at least comprises:

an alpha olefin having a number-average molecular weight of not higher than 600; and a polyethylene wax having a number-average molecular weight of not higher than 600, a melting viscosity of lower than 15 mPa·s at 140° C. and a crystallinity of lower than 15 mPa·s at 140° C. and crystallinity of lower than 95%, wherein a ratio of the alpha olefin to the polyethylene wax is in a range of from 1:10 to 2:1, wherein a maximum of absorption peaks in a heat-up time absorption calorie curve in a DSC curve of the toner measured by a differential scanning calorimeter is at a temperature not higher than 75° C., and wherein an onset temperature in absorption of heat is not higher than 65° C.

51. The image-forming system according to claim 50, wherein the developing unit comprises a center developing unit using a plurality of developing magnetic rolls including a least one developing magnetic roll rotating in a forward direction and at least one developing magnetic roll rotating in a backward direction with respect to a direction of movement of the electrostatic charge holding member.

52. An image-forming system, comprising:

an electrostatic charge holding member;

an electrophotographic toner;

a developing unit that obtains a recording image by visualizing an electrostatic charge latent image formed on an electrostatic charge holding member with the electrophotographic toner;

a transfer unit that transfers a visualized toner image onto a recording medium; and a fixing unit that fixes the toner image transferred onto the recording medium, wherein the electrophotographic toner comprises:

a fixing resin;

a colorant; and a wax, wherein the wax at least comprises:

a paraffin wax having a number-average molecular weight of 300 to 600; and a polyethylene wax having a number-average molecular weight of not higher than 600, a melting viscosity of lower than 10 mPa·s at 140° C. and a crystallinity of lower than 90%, wherein a ratio of the paraffin wax to the polyethylene wax is in a range of from 1:10 to 2:1, wherein a maximum of absorption peaks in a heat-up time absorption calorie curve in a DSC curve of the toner measured by a differential scanning colorimeter is at a temperature not higher than 75° C., and wherein an onset temperature in absorption of heat is not higher than 55° C.

53. The image-forming system according to claim 52, wherein the developing unit comprises a center feed developing unit using a plurality of developing magnetic rolls including at least one developing magnetic roll rotating in a forward direction and at least one developing magnetic roll rotating in a backward direction with respect to a direction of movement of the electrostatic charge holding member.

* * * * *